US010499471B2

(12) United States Patent
Bong et al.

(10) Patent No.: US 10,499,471 B2
(45) Date of Patent: Dec. 3, 2019

(54) LIGHT-EMITTING DIODE LIGHTING MODULE AND LIGHTING APPARATUS INCLUDING THE SAME

(71) Applicant: Samsung Electronics Co., Ltd., Suwon-si, Gyeonggi-do (KR)

(72) Inventors: Sang-cheol Bong, Seoul (KR); Min-soo Han, Suwon-si (KR)

(73) Assignee: Samsung Electronics Co., Ltd., Suwon-Si, Gyeonggi-do (KR)

( * ) Notice: Subject to any disclaimer, the term of this patent is extended or adjusted under 35 U.S.C. 154(b) by 0 days.

(21) Appl. No.: 16/127,415

(22) Filed: Sep. 11, 2018

(65) Prior Publication Data

US 2019/0320513 A1 Oct. 17, 2019

(30) Foreign Application Priority Data

Apr. 13, 2018 (KR) ..... 10-2018-0043577
Jun. 1, 2018 (KR) ..... 10-2018-0063758

(51) Int. Cl.
*H05B 33/08* (2006.01)
*F21V 23/04* (2006.01)

(52) U.S. Cl.
CPC ..... *H05B 33/0857* (2013.01); *F21V 23/04* (2013.01); *H05B 33/083* (2013.01)

(58) Field of Classification Search
CPC .... H05B 33/0857; H05B 33/083; F21V 23/04
See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |
| 7,288,758 | B2 | 10/2007 | Sherrer et al. |

(Continued)

FOREIGN PATENT DOCUMENTS

JP 2013-008547 A 1/2013

*Primary Examiner* — Dedei K Hammond
*Assistant Examiner* — Raymond R Chai
(74) *Attorney, Agent, or Firm* — Lee & Morse, P.C.

(57) ABSTRACT

A lighting module includes a light emitter including a first light-emitting diode (LED) string configured to emit light of a first color temperature and a second LED string configured to emit light of a second color temperature, a terminal unit configured to provide terminals capable of supplying a driving current to at least one of the first LED string and the second LED string, and a balancing unit including a first balance LED, a second balance LED, a first balance resistor, and a second balance resistor, the balancing unit configured to adjust a mixed color temperature, and reduce a luminance difference between the light of the mixed color temperature and one of the light of the first color temperature and the light of the second color temperature.

20 Claims, 23 Drawing Sheets

(56) References Cited

U.S. PATENT DOCUMENTS

| | | | | |
|---|---|---|---|---|
| 7,319,044 | B2 | 1/2008 | Han et al. | |
| 7,501,656 | B2 | 3/2009 | Han et al. | |
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,735,931 | B2 | 5/2014 | Han et al. | |
| 8,766,295 | B2 | 7/2014 | Kim | |
| 9,232,602 | B2 | 1/2016 | Yeh et al. | |
| 9,544,952 | B2 | 1/2017 | Wu et al. | |
| 9,860,944 | B2 | 1/2018 | Akiyama et al. | |
| 9,900,945 | B1 | 2/2018 | Janik et al. | |
| 2011/0199003 | A1* | 8/2011 | Muguruma ..... | H05B 33/0824 315/122 |
| 2013/0221861 | A1 | 9/2013 | Creusen et al. | |
| 2014/0210357 | A1* | 7/2014 | Yan ..... | H05B 33/0824 315/186 |
| 2014/0361711 | A1* | 12/2014 | Takahashi ..... | H05B 33/0812 315/294 |
| 2015/0042241 | A1 | 2/2015 | Su et al. | |
| 2016/0255683 | A1* | 9/2016 | Wu ..... | H05B 33/0812 315/192 |
| 2017/0027030 | A1 | 1/2017 | Wang et al. | |
| 2017/0027033 | A1 | 1/2017 | Chobot et al. | |
| 2018/0376555 | A1* | 12/2018 | Wang ..... | H05B 33/0845 |

* cited by examiner

LIGHT-EMITTING DIODE LIGHTING MODULE AND LIGHTING APPARATUS INCLUDING THE SAME

CROSS-REFERENCE TO RELATED APPLICATIONS

Korean Patent Application Nos. 10-2018-0043577, filed on Apr. 13, 2018 and 10-2018-0063758, filed on Jun. 1, 2018, in the Korean Intellectual Property Office, and entitled: "Light-Emitting Diode Lighting Module and Lighting Apparatus Including the Same," is incorporated by reference herein in its entirety.

BACKGROUND

1. Field

Embodiments relate to a light-emitting diode (LED) lighting module and a lighting apparatus including the same.

2. Description of the Related Art

LEDs have advantages, such as a long lifetime and low power consumption, and are widely used in recent lighting applications.

SUMMARY

Embodiments are directed to a lighting module, including: a light emitter including a first light-emitting diode (LED) string configured to emit light of a first color temperature and a second LED string configured to emit light of a second color temperature, a terminal unit configured to provide terminals capable of supplying a driving current to at least one of the first LED string and the second LED string, and a balancing unit including a first balance LED, a second balance LED, a first balance resistor, and a second balance resistor, the balancing unit configured to adjust a mixed color temperature that is a color temperature of light emitted from the light emitter when the driving current is supplied to the first LED string and the second LED string, and reduce a luminance difference between the light of the mixed color temperature and one of the light of the first color temperature emitted from the light emitter when the driving current is supplied to the first LED string and the light of the second color temperature emitted from the light emitter when the driving current is supplied to the second LED string.

Embodiments are also directed to a lighting module, including: a lighting unit including a first light-emitting diode (LED) string configured to emit light of a first color temperature and a second LED string configured to emit light of a second color temperature, an input terminal configured to provide a driving current, at least three selection terminals, when connected to the input terminal, configured to supply the driving current to at least one of the first LED string and the second LED string, and a balancing unit between the at least three selection terminals and the light emitter, wherein the balancing unit includes a first balance LED configured to emit light of the first color temperature, a first balance resistor connected in series to the first balance LED, a second balance LED configured to emit light of the second color temperature, and a second balance resistor connected in series to the second balance LED.

Embodiments are also directed to a lighting apparatus, including: a first light-emitting diode (LED) string configured to emit light of a first color temperature, a second LED string configured to emit light of a second color temperature, an input terminal configured to supply a driving current, a first selection terminal configured to supply the driving current to the first LED string, a second selection terminal configured to divide the driving current and supply the divided driving current to the first LED string and the second LED string, a third selection terminal configured to supply the driving current to the second LED string, a switch configured to connect the input terminal to one of the first selection terminal, the second selection terminal, and the third selection terminal, and a balancing unit including a first balance resistor between the second selection terminal and the first LED string, and a second balance resistor between the second selection terminal and the second LED string.

BRIEF DESCRIPTION OF THE DRAWINGS

Features will become apparent to those of skill in the art by describing in detail example embodiments with reference to the attached drawings in which.

DETAILED DESCRIPTION

Figure 1:
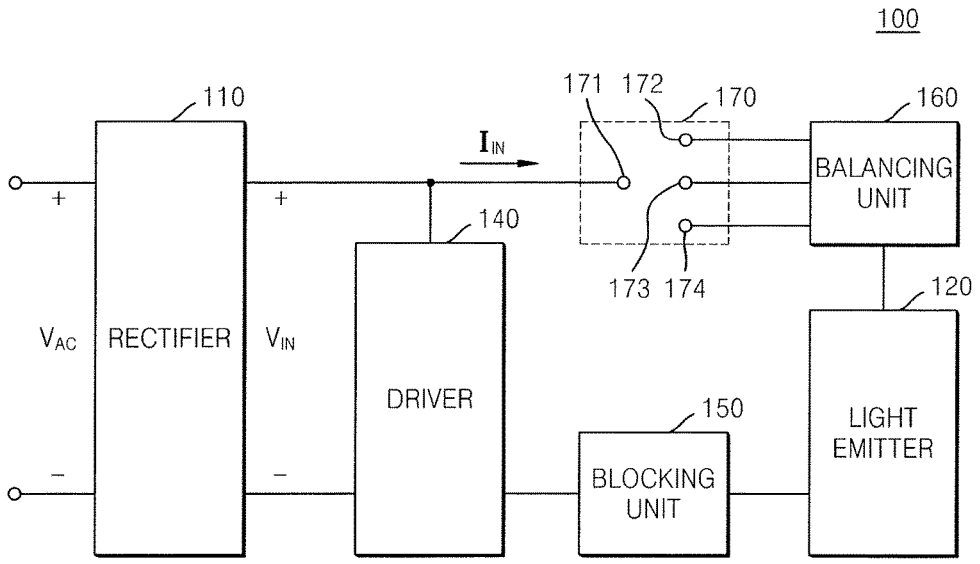
FIG. 1 illustrates a block diagram of a lighting module according to an example embodiment.

FIG. 1 illustrates a block diagram of a lighting module 100 according to an example embodiment.

Referring to FIG. 1, the lighting module 100 may include a light emitter 120, a terminal unit 170, and a balancing unit 160. The light emitter 120 may include a first light-emitting diode (LED) string configured to emit light of a first color temperature and a second LED string configured to emit light of a second color temperature. The light emitter 120 may be configured to emit light of one of the first color temperature, the second color temperature, and a mixed color temperature between the first color temperature and the second color temperature by using the first LED string and the second LED string.

The terminal unit 170 may be configured to provide terminals (for example, 171 through 174) capable of supplying a driving current $I_{IN}$ to at least one of the first LED string and the second LED string of the light emitter 120. The terminal unit 170 may include an input terminal 171 and at least three of the first through third selection terminals 172 through 174. The input terminal 171 may be configured to be supplied with the driving current $I_{IN}$. Each of the at least three of the first through third selection terminals 172 through 174 may be configured to be individually connected to the input terminal 171 by a switch. Each of the at least three of the first through third selection terminals 172 through 174, when connected to the input terminal 171 by the switch, may be configured to supply the driving current $I_{IN}$ to at least one of the first LED string and the second LED string of the light emitter 120.

The balancing unit 160 may be between the light emitter 120 and the terminal unit 170. The balancing unit 160 may be configured to adjust the mixed color temperature to a certain value between the first color temperature and the second color temperature. The balancing unit 160 may be further configured to compensate for a luminance difference between light of the first color temperature emitted from the light emitter 120, light of the second color temperature emitted from the light emitter 120, and light of the mixed color temperature emitted from the light emitter 120. For example, the lighting module 100 may reduce the luminance differences by the color temperature by including the balancing unit 160.

In an example embodiment, the lighting module 100 may further include a rectifier 110 configured to provide a driving voltage $V_{IN}$ that changes as a function of time, from an alternating current (AC) voltage $V_{AC}$. A lighting module, which is directly connected to an AC power source, such as the lighting module 100, may be referred to as an AC direct type module. The AC direct type module may not require an AC-direct current (DC) converter for generating a constant current. Thus, the AC direct type module such as the lighting module 100 according to an example embodiment may be less expensive and less bulky.

In an example embodiment, the lighting module 100 may further include a driver 140.

The driver 140 may be configured to receive the driving voltage $V_{IN}$ and control the number of LEDs in which the driving current $I_{IN}$ flows through the LEDs in the light emitter 120 according to the driving voltage $V_{IN}$. Details of an operation of the driver 140 will be described later with reference to FIGS. 3 and 4. The lighting module 100 may drive both the first LED string and the second LED string of the light emitter 120 by using one driver 140, and thus, cost of the lighting module 100 may be lower than that of a lighting module requiring a driver for each LED string. In an example embodiment, the lighting module 100 may further include a blocking unit 150 between the driver 140 and the light emitter 120. The blocking unit 150 may be configured to block current flowing from the driver 140 to the first LED string or the second LED string of the light emitter 120.

Figure 2A:
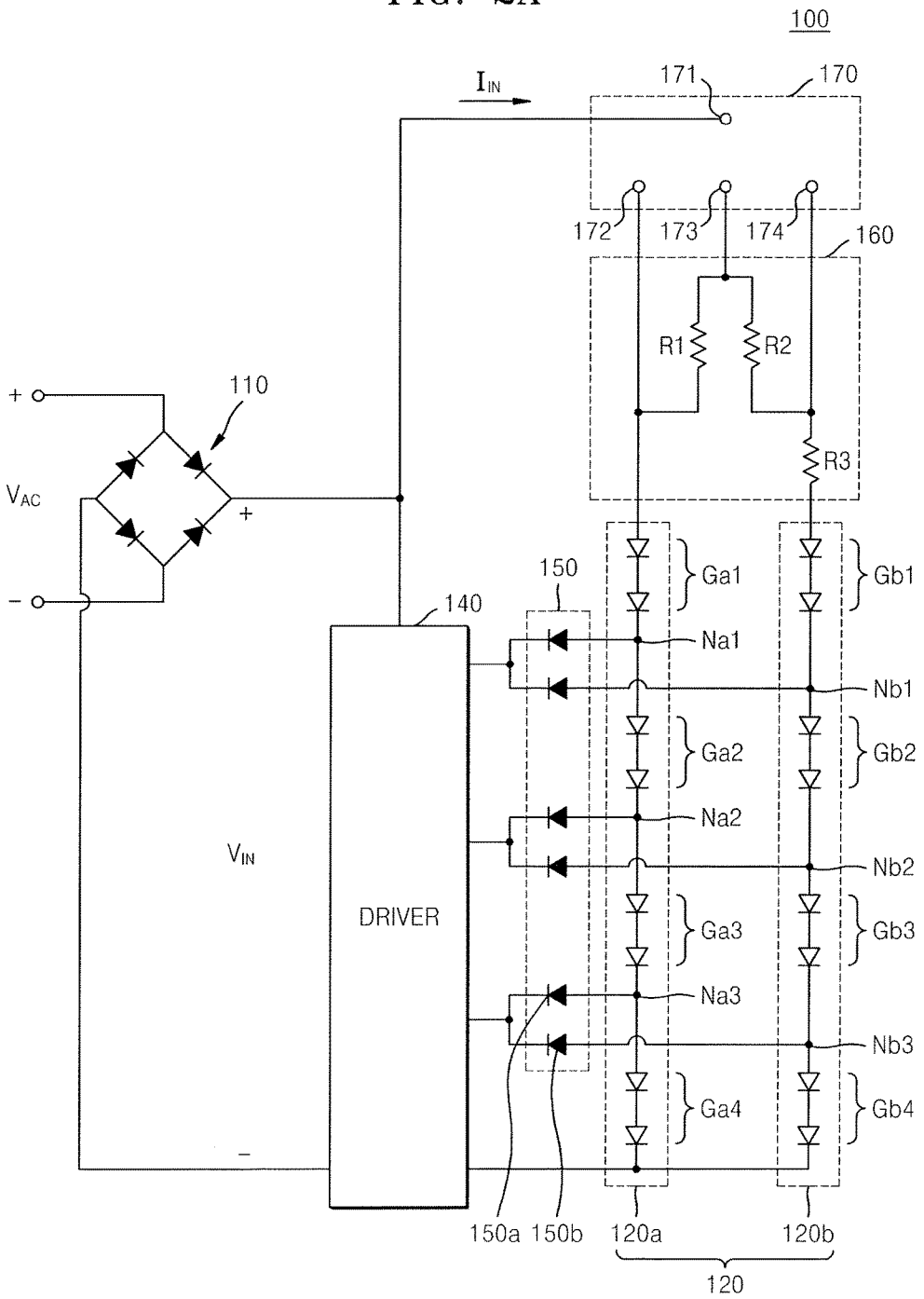
FIG. 2A illustrates a circuit diagram of a lighting module according to an example embodiment.

FIG. 2A illustrates a circuit diagram of the lighting module 100 according to an example embodiment.

Referring to FIG. 2A, the light emitter 120 may include a first LED string 120*a* and a second LED string 120*b*. The first LED string 120*a* may include LEDs connected in series to each other and each configured to emit light of a first color temperature. The second LED string 120*b* may include LEDs connected in series to each other and each configured to emit light of a second color temperature.

The terminal unit 170 may include the input terminal 171, a first selection terminal 172, a second selection terminal 173, and a third selection terminal 174. The input terminal 171 may be configured to be supplied with the driving current TIN. The first selection terminal 172, when connected to the input terminal 171, e.g., by a switch, may be configured to supply the driving current $I_{IN}$ to the first LED string 120*a*. The second selection terminal 173, when connected to the input terminal 171 by the switch, may be configured to divide the driving current $I_{IN}$ to supply the divided current $I_{IN}$ respectively to the first LED string 120*a* and the second LED string 120*b*. The third selection terminal 174, when connected to the input terminal 171 by the switch, may be configured to supply the driving current $I_{IN}$ to the second LED string 120*b*.

The balancing unit 160 may be configured to adjust the mixed color temperature and to reduce the luminance difference between light of the mixed color temperature and one of the light of the first color temperature and the light of the second color temperature. For example, the balancing unit 160 may include a first balance resistor R1 and a second balance resistor R2. The first balance resistor R1 may be between the second selection terminal 173 and the first LED string 120*a*. The second balance resistor R2 may be between the second selection terminal 173 and the second LED string 120*b*. The first and second balance resistors R1 and R2 may adjust the mixed color temperature. For example, when the second color temperature is higher than the first color temperature, less current may be provided to the first LED string 120*a* and more current may be provided to the second LED string 120*b* to increase the mixed color temperature, and thus a resistance value of the first balance resistor R1 may be relatively increased and the resistance value of the second balance resistor R2 may be relatively decreased.

In addition, the first and second balance resistors R1 and R2 may adjust a luminance of the light of the mixed color temperature. The first and second balance resistors R1 and R2 may reduce the luminance difference between the light of the mixed color temperature and one of the light of the first color temperature and the light of the second color temperature. For example, when the luminance of the mixed color temperature is less than that of the light of the first color temperature, the resistance value of the first balance resistor R1 and the resistance value of the second balance resistor R2 may be decreased.

In an example embodiment, the balancing unit 160 may be configured to reduce the luminance difference between the light of the first color temperature and the light of the second color temperature. For example, the balancing unit 160 may further include a third balance resistor R3. The third balance resistor R3 may be configured to reduce the luminance difference between the light of the first color temperature emitted from the light emitter 120 and the light of the second color temperature emitted from the light emitter 120. For example, when the second color temperature is higher than the first color temperature, the third balance resistor R3 may be between the third selection terminal 174 and the second LED string 120*b* to reduce the current flowing through the second LED string 120*b*. In this case, the second balance resistor R2 may be between the third balance resistor R3 and the second selection terminal 173.

In an example embodiment, the lighting module 100 may further include the rectifier 110 including a rectifying circuit. The rectifier 110 may generate the driving voltage $V_{IN}$, which may vary as a function of time. In an example embodiment, the lighting module 100 may further include the driver 140 configured to receive the driving current TIN from the first LED string 120*a* and the second LED string 120*b*. In an example embodiment, the lighting module 100 may further include the blocking unit 150 including first block diodes 150*a* and second block diodes 150*b*. The first block diodes 150*a* may be between the driver 140 and the first LED string 120*a*, and the second block diodes 150*b* may be between the driver 140 and the second LED string 120*b*. The first block diodes 150*a* may be configured to block current flowing from the driver 140 to the first LED string 120*a*, and the second block diodes 150*b* may be configured to block current from the driver 140 to the second LED string 120*b*.

Figure 2B:
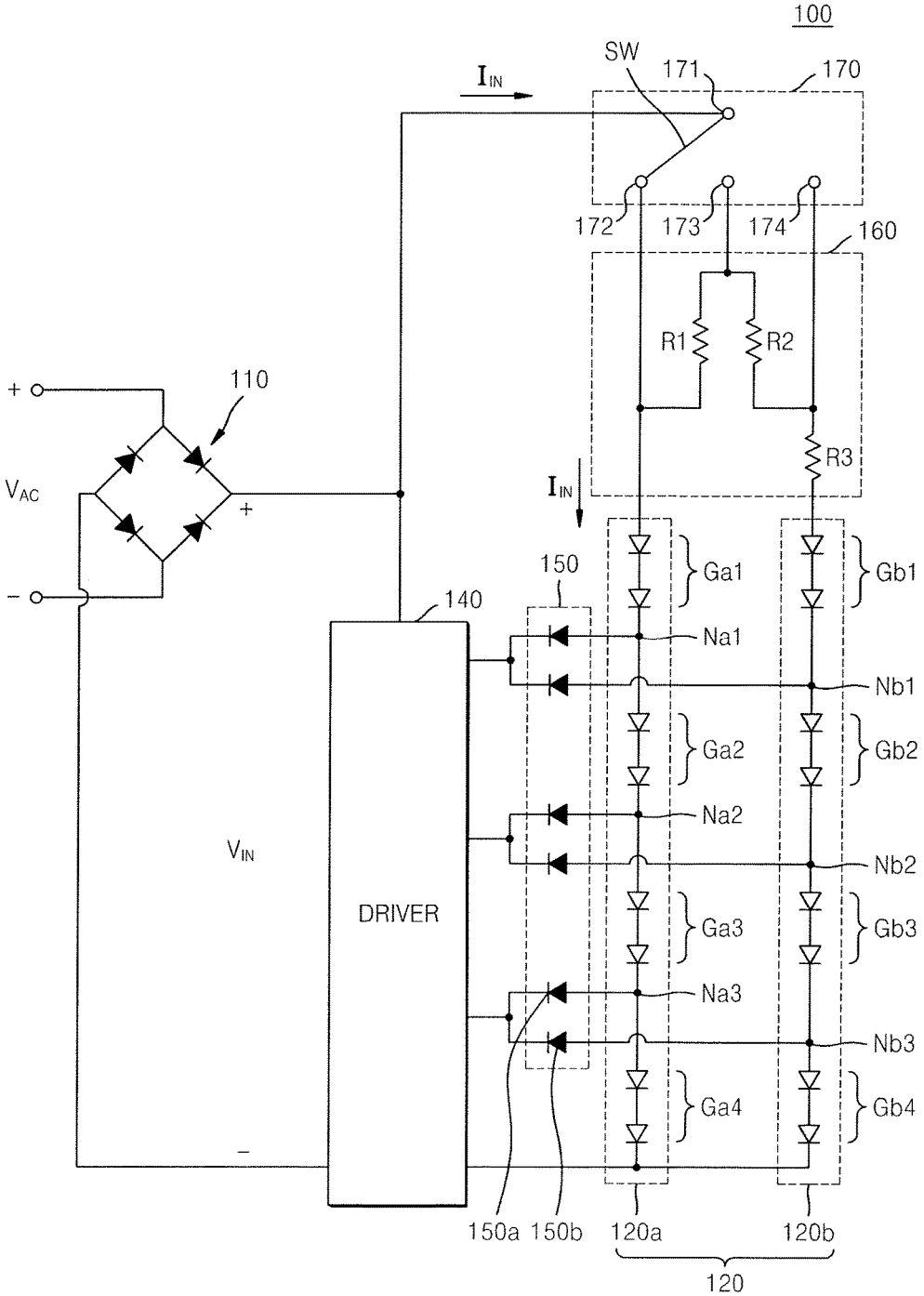
FIG. 2B illustrates a circuit diagram when an input terminal is connected to a first selection terminal by a switch in the lighting module of FIG. 2A.

FIG. 2B illustrates a circuit diagram when the input terminal 171 is connected to the first selection terminal 172 by a switch SW in the lighting module of FIG. 2A.

Referring to FIG. 2B, the driving current $I_{IN}$ supplied to the input terminal 171 may be supplied to the first selection terminal 172 via the switch SW. The driving current $I_{IN}$ supplied to the first selection terminal 172 may flow to the first LED string 120*a*. Accordingly, the light emitter 120 may emit the light of the first color temperature.

Figure 2C:
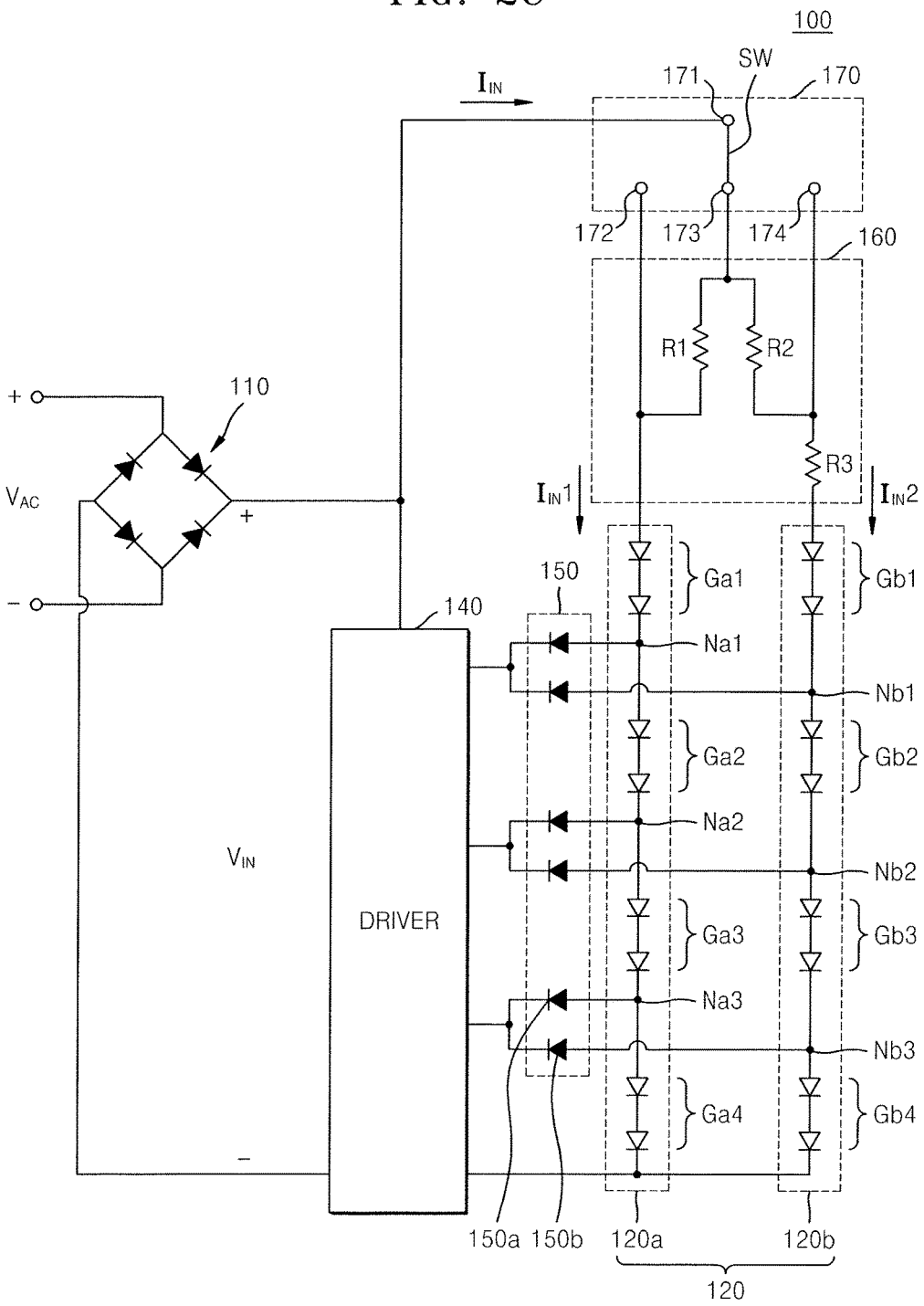
FIG. 2C illustrates a circuit diagram when the input terminal is connected to a second selection terminal by the switch in the lighting module of FIG. 2A.

FIG. 2C illustrates a circuit diagram when the input terminal 171 is connected to the second selection terminal 173 by the switch SW in the lighting module 100 of FIG. 2A.

Referring to FIG. 2C, the driving current u N supplied to the input terminal 171 may be supplied to the second selection terminal 173 via the switch SW. A first portion $I_{IN}$1 of the driving current $I_{IN}$ supplied to the second selection terminal 173 may flow through the first balance resistor R1 to the first LED string 120*a*. A second portion $I_{IN}$2 that is, the remaining portion of the driving current $I_{IN}$ supplied to the second selecting terminal 173 may flow through the second balance resistor R2 and the third balance resistor R3 to the second LED string 120*b*. Accordingly, the light emitter 120 may emit the light of the mixed color temperature in which the light of the first color temperature emitted from the first LED string 120*a* and the light of the second color temperature emitted from the second LED string 120*b* are mixed.

Figure 2D:
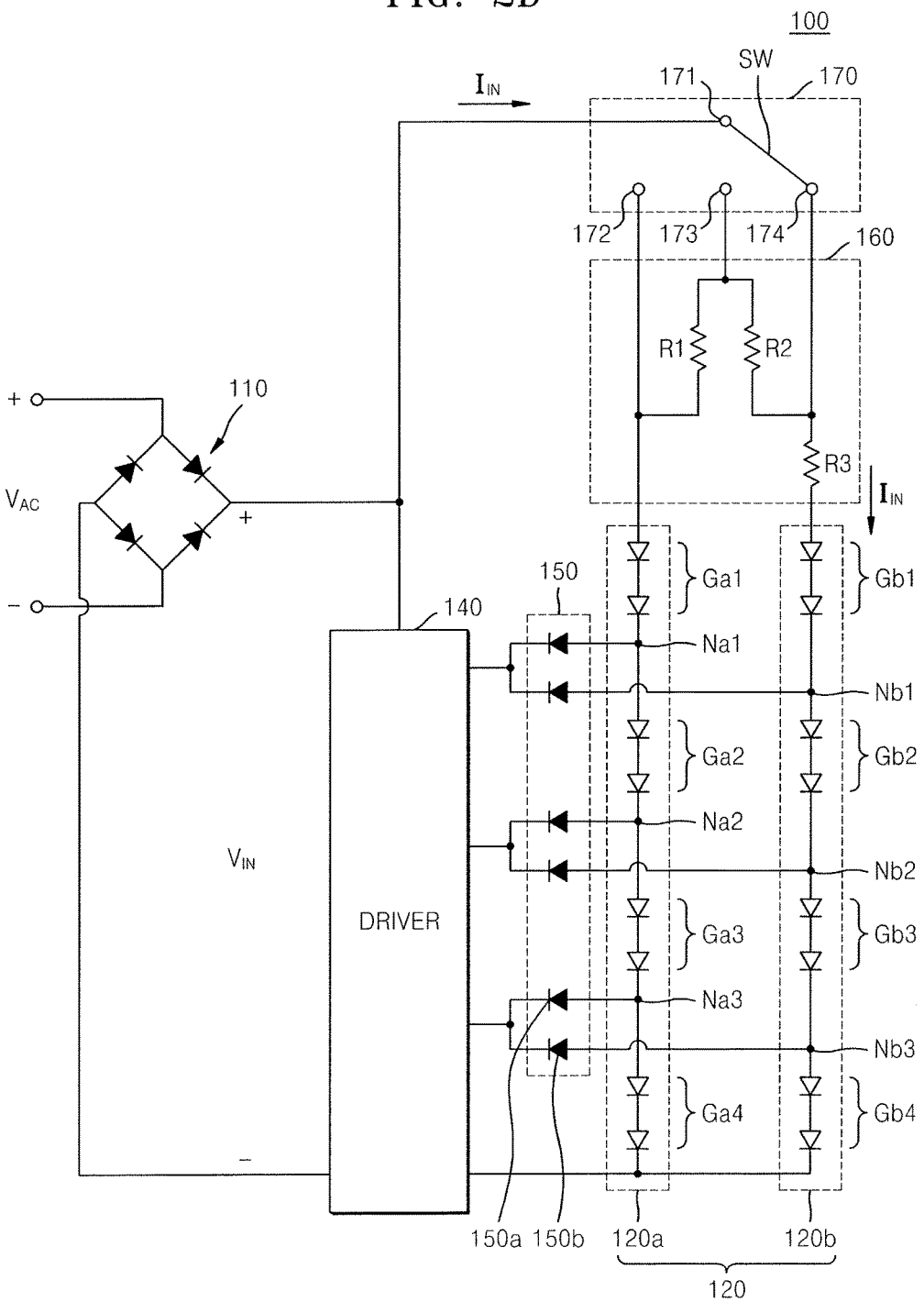
FIG. 2D illustrates a circuit diagram when the input terminal is connected to a third selection terminal by the switch in the lighting module of FIG. 2A.

FIG. 2D illustrates a circuit diagram when the input terminal 171 is connected to the third selection terminal 174 by the switch SW in the lighting module 100 of FIG. 2A.

Referring to FIG. 2D, the driving current $I_{IN}$ supplied to the input terminal 171 may be supplied to the third selection terminal 174 via the switch SW. The driving current $I_{IN}$ supplied to the third selection terminal 174 may flow through the third balance resistor R3 to the second LED string 120*b*. Accordingly, the light emitter 120 may emit the light of the second color temperature.

Figure 3:
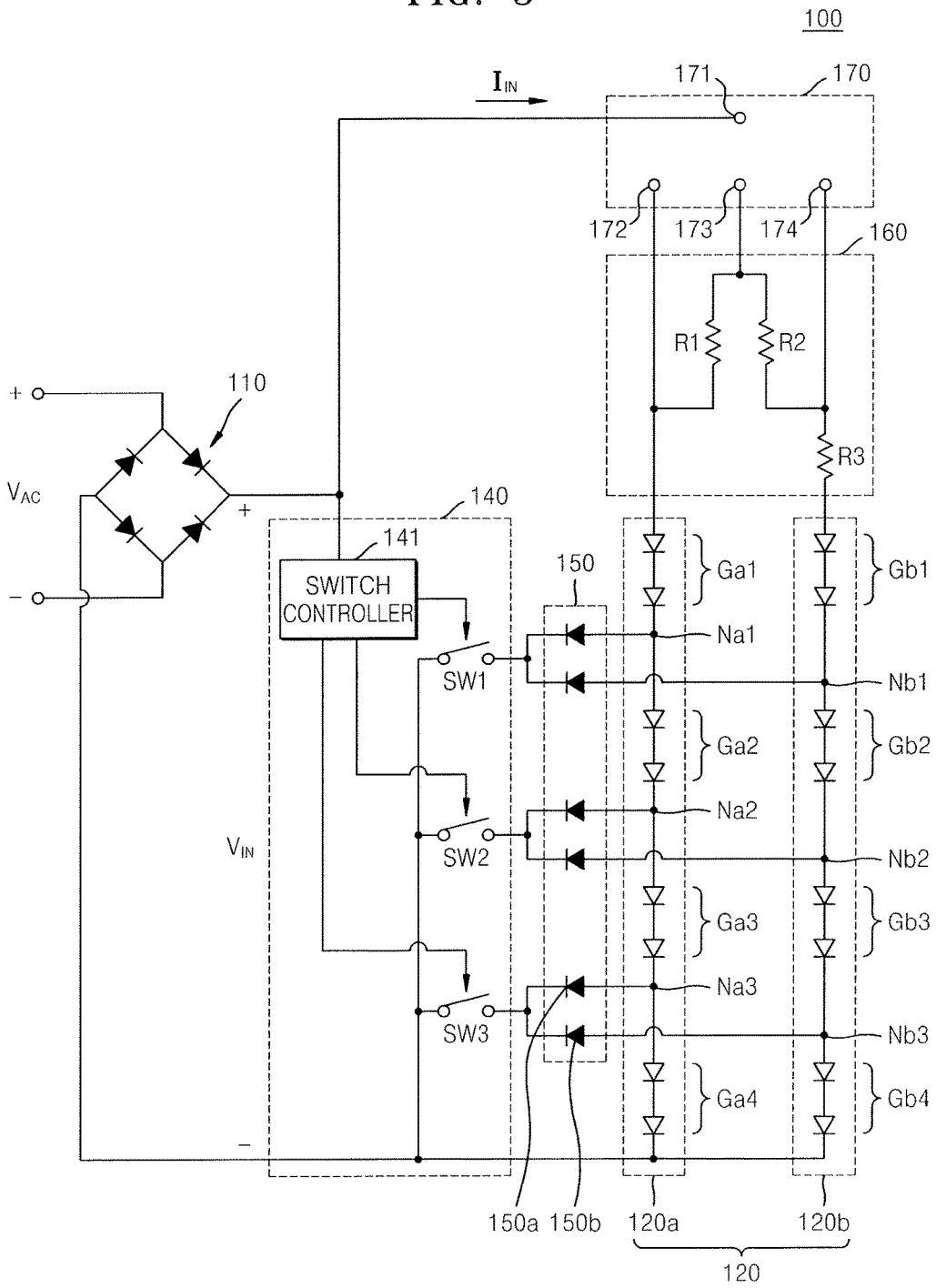
FIGS. 3 and 4 illustrate respectively a circuit diagram and a graph for explaining an operation of a driver included in a lighting module according to an example embodiment.
Figure 4:
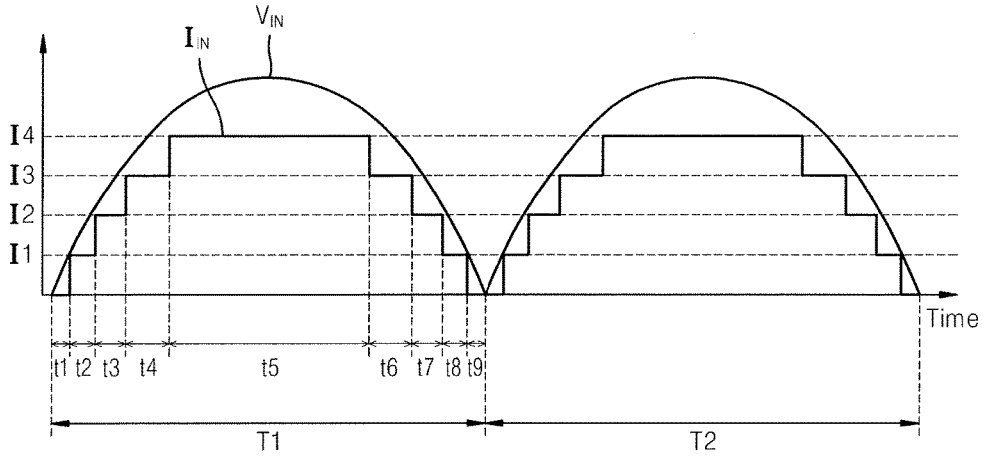

FIGS. 3 and 4 respectively illustrate a circuit diagram and a graph for explaining an operation of the driver 140 included in the lighting module 100 according to an example embodiment.

Referring to FIG. 3, the driver 140 may include a switch controller 141 and first through third internal switches SW1 through SW3. The first through third internal switches SW1 through SW3 may be connected to nodes (Na1 through Na3) between first through fourth LED groups (Ga1 through Ga4) in the first LED string 120*a* via the first block diodes 150*a*. In addition, the first through third internal switches SW1 through SW3 may be connected to nodes (Nb1 through Nb3) between first through fourth LED groups (Gb1 through Gb4) in the second LED string 120*b* via the second block diodes 150*b*. The switch controller 141 may determine the number of LED groups through which the driving current $I_{IN}$ flows among the first through fourth LED groups (Ga1 through Ga4 and Gb1 through Gb4) in the light emitter 120 by controlling operations of the first through third internal switches SW1 through SW3 according to the driving voltage $V_{IN}$.

As illustrated in FIG. 4, the driving voltage $V_{IN}$ may have a waveform having a certain period generated by rectifying the AC voltage $V_{AC}$. For example, one period T1 may include nine intervals (first through ninth intervals t1 through t9). A magnitude of the driving voltage $V_{IN}$ may be small for operating the first through fourth LED groups (Ga1 through Ga4 and Gb1 through Gb4) in the light emitter 120 in the first interval t1 and the ninth interval t9. Accordingly, the first through fourth LED groups (Ga1 through Ga4 and Gb1 through Gb4) in the light emitter 120 may be turned off.

The switch controller 141 may turn on only the first internal switch SW1 and supply a first current I1 to the input terminal 171 in the second interval t2 and the eighth interval t8. Current supplied to the first LED group Ga1 of the first LED string 120*a* may not flow to the second LED group Ga2 of the first LED string 120*a*, but may flow through the first block diode 150*a* to the driver 140. Similarly, current supplied to the first LED group Gb1 of the second LED string 120*b* may not flow to the second LED group Gb2 of the second LED string 120*b*, but may flow through the second block diode 150*b* to the driver 140. Thus, the first LED group Ga1 of the first LED string 120*a* and/or the first LED group Gb1 of the second LED string 120*b* may be turned on.

The switch controller 141 may turn on only the second internal switch SW2 and supply a second current I2 to the input terminal 171 in the third interval t3 and the seventh interval t7. The current supplied to the first LED group Ga1 and the second LED group Ga2 of the first LED string 120*a* may not flow through the third LED group Ga3 of the first LED string 120*a*, but may flow through the first block diode 150*a* to the driver 140. Similarly, the current supplied to the first LED group Gb1 and the second LED group Gb2 of the second LED string 120*b* may not flow through the third LED group Gb3 of the second LED string 120*b*, but may flow through the second block diode 150*b* to the driver 140. Thus, the first LED group Ga1 and the second LED group Ga2 of the first LED string 120*a* and/or the first LED group Gb1 and the second LED group Gb2 of the second LED string 120*b* may be turned on.

The switch controller 141 may turn on only the third internal switch SW3 and supply a third current I3 to the input terminal 171 in the fourth interval t4 and the sixth interval t6. Current supplied to the first through third LED groups Ga1 through Ga3 of the first LED string 120*a* may not flow through the fourth LED group Ga4 of the first LED string 120*a*, but may flow through the first block diode 150*a* to the driver 140. Similarly, current supplied to the first through third LED groups Gb1 through Gb3 of the second LED string 120*b* may not flow through the fourth LED group Gb4 of the second LED string 120*b*, but may flow through the second block diode 150*b* to the driver 140. Accordingly, the first through third LED groups Ga1 through Ga3 of the first LED string 120*a* and/or the first through third LED groups Gb1 through Gb3 of the second LED string 120*b* may be turned on.

The switch controller 141 may turn off all of the first through third internal switches SW1 through SW3 and supply a fourth current I4 to the input terminal 171 in the fifth interval t5. The driving current $I_{IN}$ may flow through all of the first through fourth LED groups Ga1 through Ga4 of the first LED string 120*a* and/or all of the first through fourth LED groups Gb1 through Gb4 of the second LED string 120*b*. Thus, all of the first through fourth LED groups Ga1 through Ga4 of the first LED string 120*a* and/or all of the first through fourth LED groups Gb1 through Gb4 of the second LED string 120*b* may be turned on.

Figure 5:
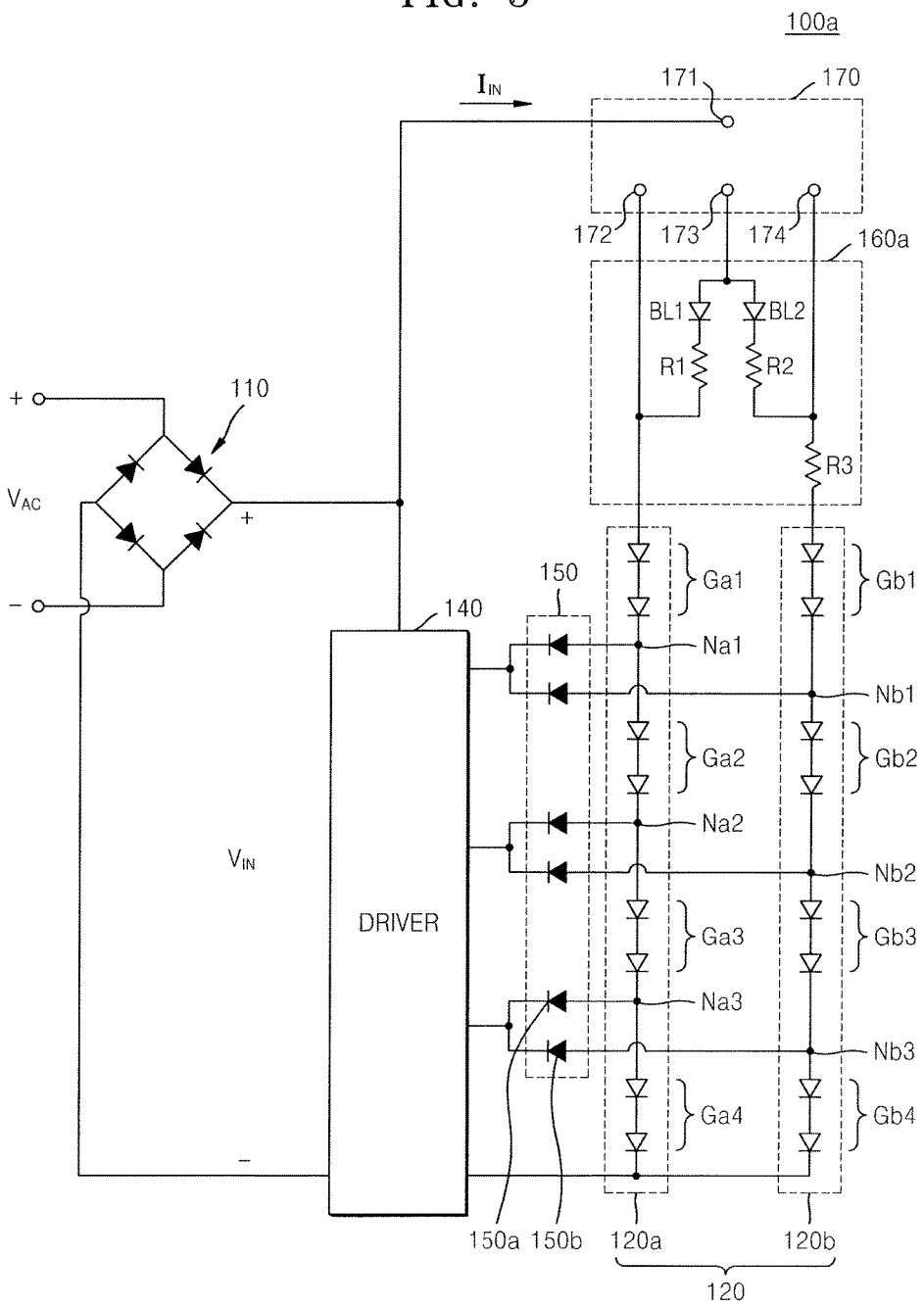
FIG. 5 illustrates a circuit diagram of a lighting module according to an example embodiment.

FIG. 5 illustrates a circuit diagram of a lighting module 100*a* according to an example embodiment. Hereinafter, differences between the embodiment illustrated in FIG. 5 and the embodiment illustrated in FIG. 2 are described.

Referring to FIG. 5, a balancing unit 160*a* may further include a first balance LED BL1 and/or a second balance LED BL2. The first balance resistor R1 and the first balance LED BL1 may be between the second selection terminal 173 and the first LED string 120*a*. The second balance resistor R2 and the second balance LED BL2 may be between the second selection terminal 173 and the second LED string 120*b*. When the balancing unit 160*a* includes the third balance resistor R3, the second balance resistor R2 and the second balance LED BL2 may be between the second selection terminal 173 and the third balance resistor R3. The first balance LED BL1 may be connected in series to the first balance resistor RE and the second balance LED BL2 may be connected in series to the second balance resistor R2. In an example embodiment, the first balance LED BL1 may be configured to emit the light of the first color temperature, and the second balance LED BL2 may be configured to emit the light of the second color temperature. The first balance LED BL1 and the second balance LED BL2 may control the mixed color temperature together with the first and second balance resistors R1 and R2, and may reduce the luminance difference between the light of the mixed color temperature and one of the light of the first color temperature and the light of the second color temperature together with the first and second balance resistors R1 and R2.

When the balancing unit 160*a* includes LEDs such as the first balance LED BL1 and the second balance LED BL2, power consumed in the first through third resistors R1 through R3 of the balancing unit 160*a* may be less than that in the case when the balancing unit 160*a* includes only the first through third balance resistors R1 through R3. Accordingly, a total volume of the first through third balance resistors R1 through R3 may decrease and flexibility of lighting design may increase. In addition, heat generated in the first through third balance resistors R1 through R3 may be reduced, such that the reliability of the lighting module 100*a* may be improved and the service life of the lighting module 100*a* may prolonged. In addition, power wasted by the heat generated in the first through third balance resistors R1 through R3 may be reduced and thus, the lighting module 100*a* may have an improved light efficiency.

Figure 6A:
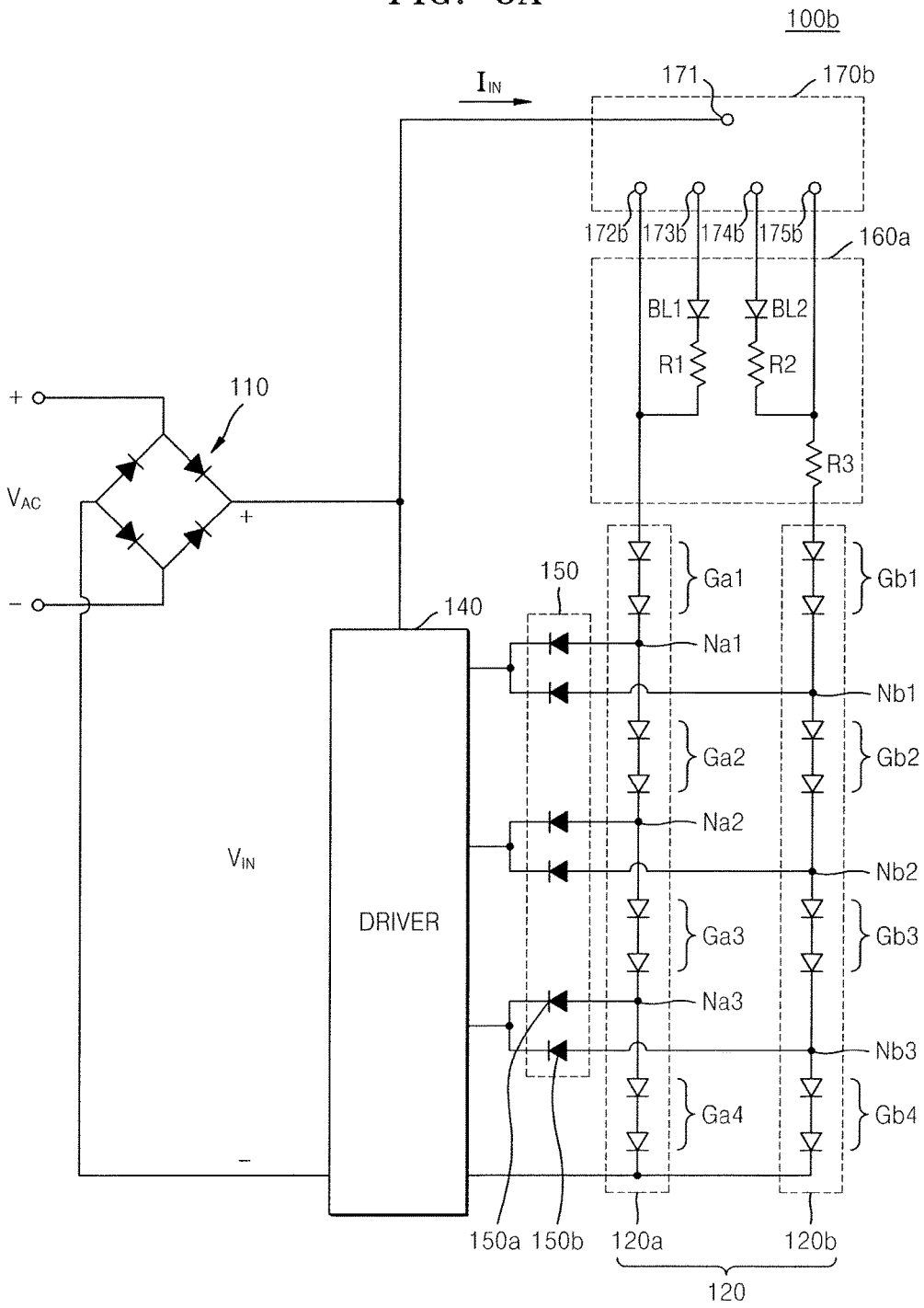
FIG. 6A illustrates a circuit diagram of a lighting module according to an example embodiment.

FIG. 6A illustrates a circuit diagram of a lighting module 100*b* according to an example embodiment. Hereinafter, differences between the embodiment illustrated in FIG. 6A and the embodiment illustrated in FIG. 5 are described.

Referring to FIG. 6A, a terminal unit 170*b* may include the input terminal 171 and four selection terminals (first through fourth selection terminals 172*b* through 175*b*). When the first selection terminal 172*b* and the second selection terminal 173*b* are connected to the input terminal 171, each of the first selection terminal 172*b* and the second selection terminal 173*b* may be configured to supply the driving current $I_{IN}$ to the first LED string 120*a*. When the third selection terminal 174*b* and the fourth selection terminal 175*b* are connected to the input terminal 171, each of the third selection terminal 174*b* and the fourth selection terminal 175*b* may be configured to supply the driving current $I_{IN}$ to the second LED string 120*b*.

The first balance LED BL1 and the first balance resistor R1 of the balancing unit 160*a* may be between the second selection terminal 173*b* and the first LED string 120*a*. The second balance LED BL2 and the second balance resistor R2 of the balancing unit 160*a* may be between the third selection terminal 174*b* and the second LED string 120*b*. When the balancing unit 160*a* includes the third balance resistor R3, the third balance resistor R3 may be between the fourth selection terminal 175*b* and the second LED string 120*b*, and the second balance LED BL2 and the second balance resistor R2 may be between the third selection terminal 174*b* and the third balance resistor R3.

Figure 6B:
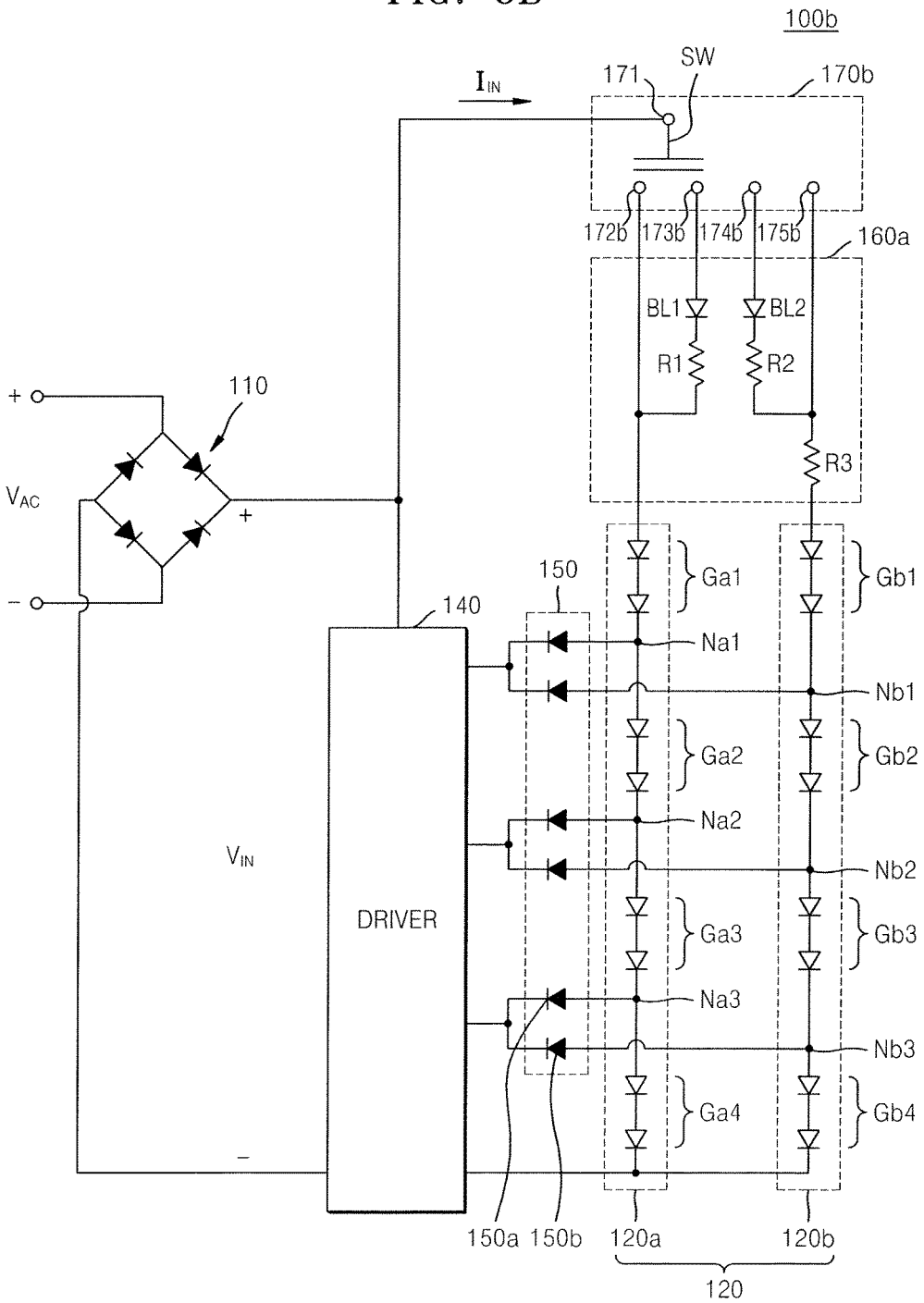
FIG. 6B illustrates a circuit diagram when an input terminal is connected to a first selection terminal and a second selection terminal by a switch in the lighting module of FIG. 6A.

FIG. 6B illustrates a circuit diagram when the input terminal 171 is connected to the first selection terminal 172*b* and the second selection terminal 173*b* by a switch SW in the lighting module 100*b* of FIG. 6A.

Referring to FIG. 6B, the driving current TIN supplied to the input terminal 171 may be supplied to the first selection terminal 172*b* via the switch SW. The driving current $I_{IN}$ supplied to the first selection terminal 172*b* may flow to the first LED string 120*a*. Accordingly, the light emitter 120 may emit the light of the first color temperature.

Figure 6C:
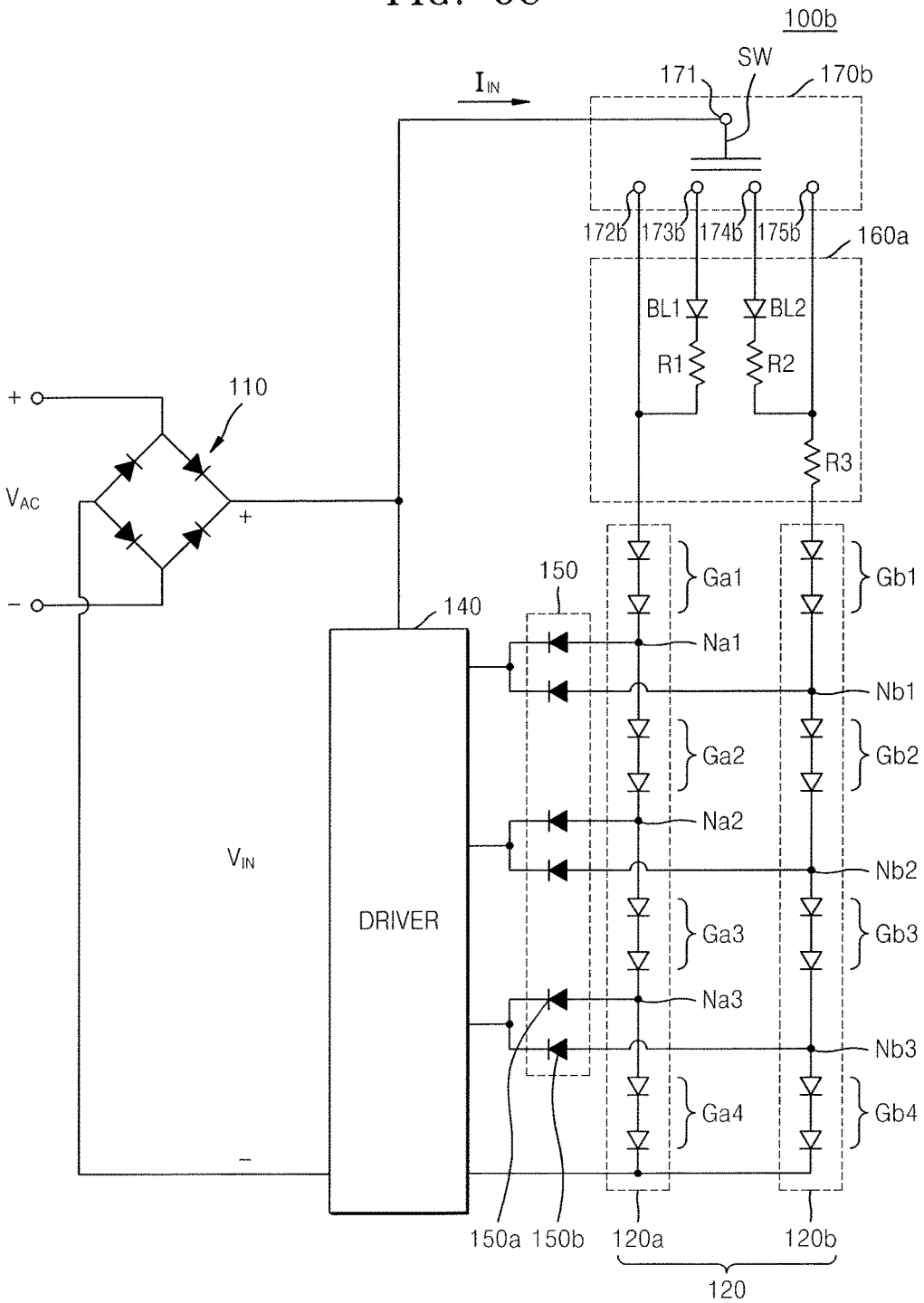
FIG. 6C illustrates a circuit diagram when the input terminal is connected to a second selection terminal and a third selection terminal by the switch in the lighting module of FIG. 6A.

FIG. 6C illustrates a circuit diagram when the input terminal 171 is connected to the second selection terminal 173*b* and the third selection terminal 174*b* by the switch SW in the lighting module 100*b* of FIG. 6A.

Referring to FIG. 6C, a portion of the driving current $I_{IN}$ supplied to the input terminal 171 may be supplied to the second selection terminal 173*b* via the switch SW and the remaining portion thereof may be supplied to the third selection terminal 174*b*. Current supplied to the second selection terminal 173*b* may flow through the first balance LED BL1 and the first balance resistor R1 to the first LED string 120*a*. Current supplied to the third selection terminal 174*b* may flow through the second balance LED BL2, the second balance resistor R2, and the third balance resistor R3 to the second LED string 120*b*. Accordingly, the light emitter 120 may emit the light of the mixed color temperature in which the light of the first color temperature and the light of the second color temperature are mixed.

Figure 6D:
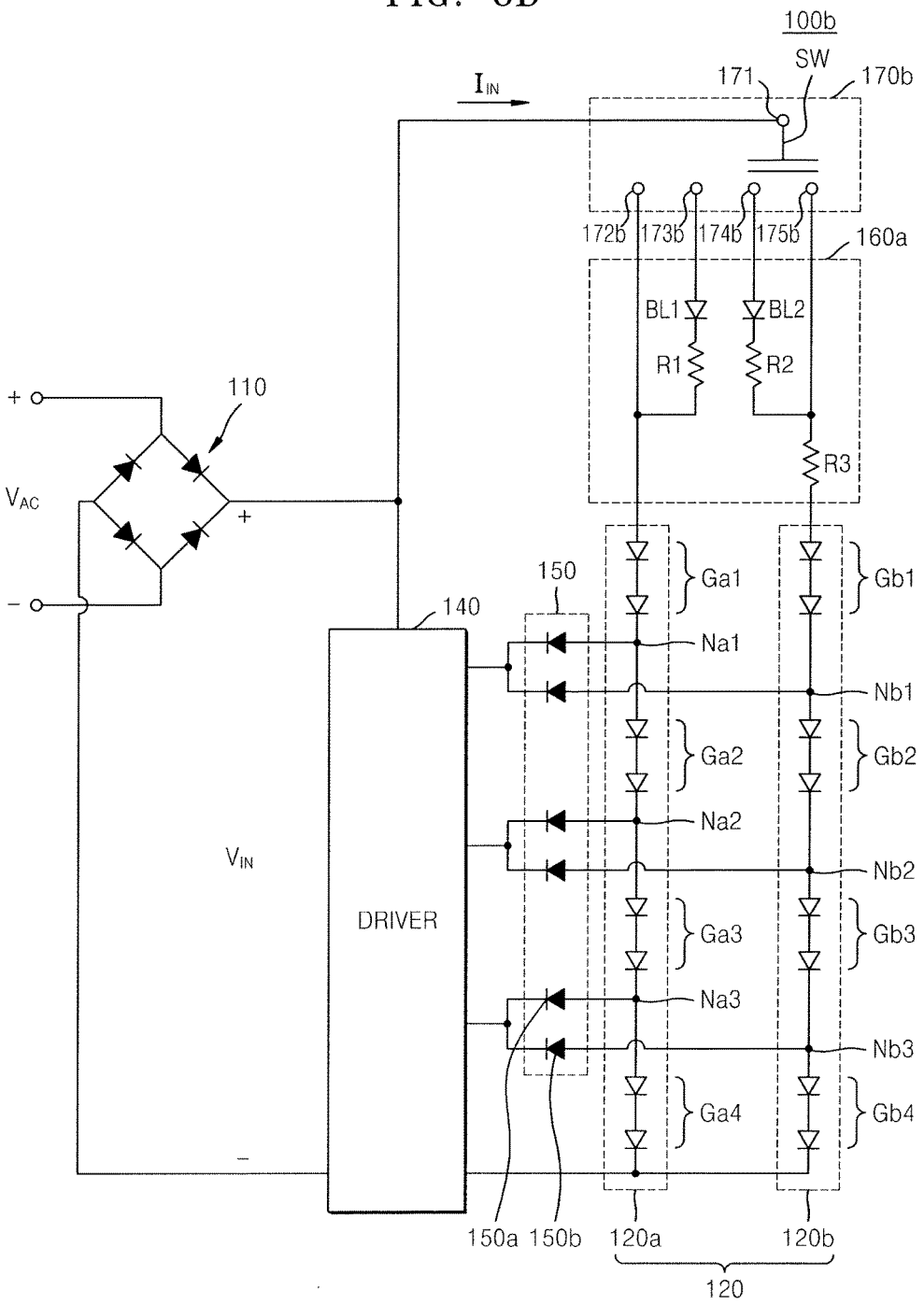
FIG. 6D illustrates a circuit diagram when the input terminal is connected to the third selection terminal and a fourth selection terminal by the switch in the lighting module of FIG. 6A.

FIG. 6D illustrates a circuit diagram when the input terminal 171 is connected to the third selection terminal 174*b* and the fourth selection terminal 175*b* by the switch SW in the lighting module 100*b* of FIG. 6A.

Referring to FIG. 6D, the driving current TIN supplied to the input terminal 171 may be supplied to the fourth selection terminal 175*b* via the switch SW. The driving current $I_{IN}$ supplied to the fourth selection terminal 175*b* may flow through the third balance resistor R3 to the second LED string 120*b*. Accordingly, the light emitter 120 may emit the light of the second color temperature.

Figure 7A:
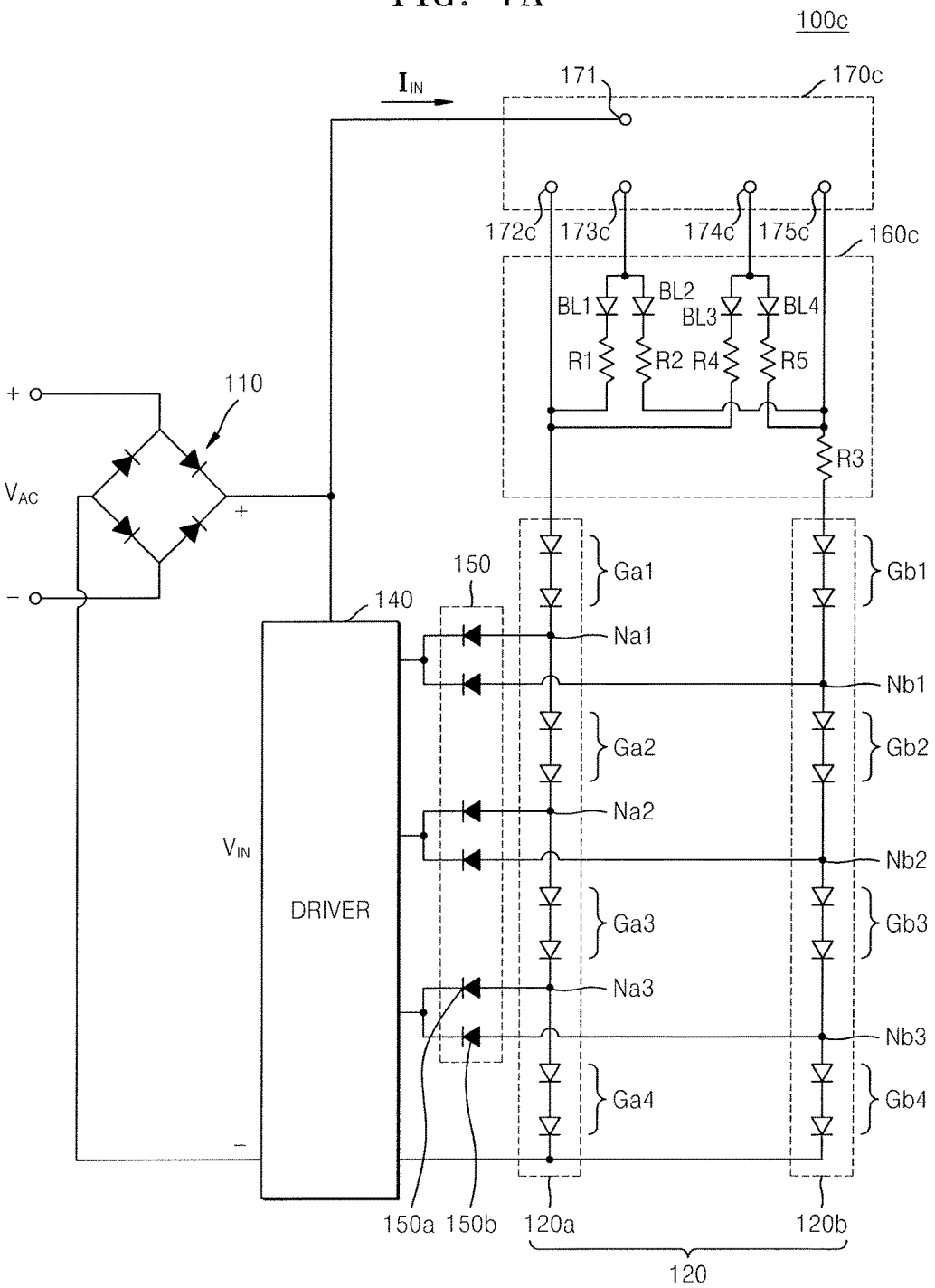
FIG. 7A illustrates a circuit diagram of a lighting module according to an example embodiment.

FIG. 7A illustrates a circuit diagram of a lighting module 100*c* according to an example embodiment. Hereinafter, differences between the embodiment illustrated in FIG. 7A and the embodiment illustrated in FIG. 5 are described.

Referring to FIG. 7A, a terminal unit 170*c* may include the input terminal 171 and four selection terminals (first through fourth selection terminals 172*c* through 175*c*). The first selection terminal 172*c*, when connected to the input terminal 171 by a switch, may be configured to supply the driving current $I_{IN}$ to the first LED string 120*a*. The second selection terminal 173*c*, when connected to the input terminal 171 by the switch, may be configured to divide the driving current $I_{IN}$ to supply the divided current TIN to the first LED string 120*a* and the second LED string 120*b*. The third selection terminal 174*c*, when connected to the input terminal 171 by the switch, like the second selection terminal 173*c*, may be configured to divide the driving current TIN to supply the divided current $I_{IN}$ to the first LED string 120*a* and the second LED string 120*b*. The fourth selection terminal 175*c*, when connected to the input terminal 171 by the switch SW, may be configured to supply the driving current $I_{IN}$ to the second LED string 120*b*.

A balancing unit 160*c* may further include a third balance LED BL3, a fourth balance resistor R4, a fourth balance LED BL4, and a fifth balance resistor R5, in addition to the first balance LED LB1, the first balance resistor R1, the second balance LED BL2, and the second balance resistor R2. The third balance LED BL3 and the fourth balance resistor R4 may be between the third selection terminal 174*c* and the first LED string 120*a*. The fourth balance LED BL4 and the fifth balance resistor R5 may be between the third selection terminal 174*c* and the second LED string 120*b*. When the balancing unit 160*c* includes the third balance resistor R3, the fourth balance LED BL4 and the fifth balance resistor R5 may be between the third selection terminal 174*c* and the third balance resistor R3. The third balance LED BL3 and the fourth balance resistor R4 may be connected in series to each other, and the fourth balance LED BL4 and the fifth balance resistor R5 may be connected in series to each other. In an example embodiment, the first balance LED BL1 and the third balance LED BL3 may each be configured to emit the light of the first color temperature, and the second balance LED BL2 and the fourth balance LED BL4 may each be configured to emit the light of the second color temperature.

Figure 7B:
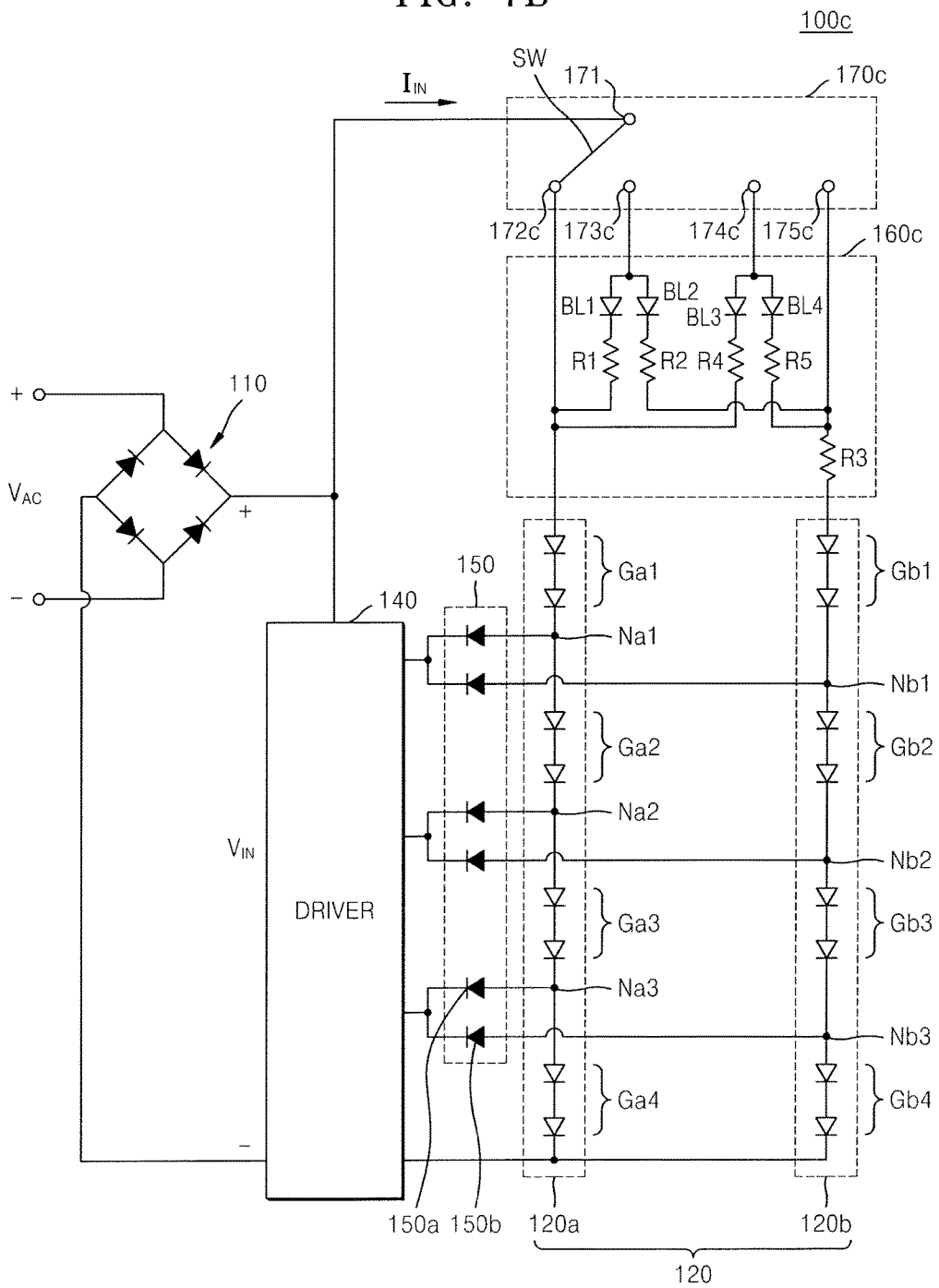
FIG. 7B illustrates a circuit diagram when an input terminal is connected to a first selection terminal by a switch in the lighting module of FIG. 7A.

FIG. 7B illustrates a circuit diagram when the input terminal 171 is connected to the first selection terminal 172*c* by the switch SW in the lighting module 100*c* of FIG. 7A.

Referring to FIG. 7B, the driving current lire supplied to the input terminal 171 may be supplied to the first selection terminal 172*c* via the switch SW. The driving current TIN supplied to the first selection terminal 172*c* may flow to the first LED string 120*a*. Accordingly, the light emitter 120 may emit the light of the first color temperature.

Figure 7C:
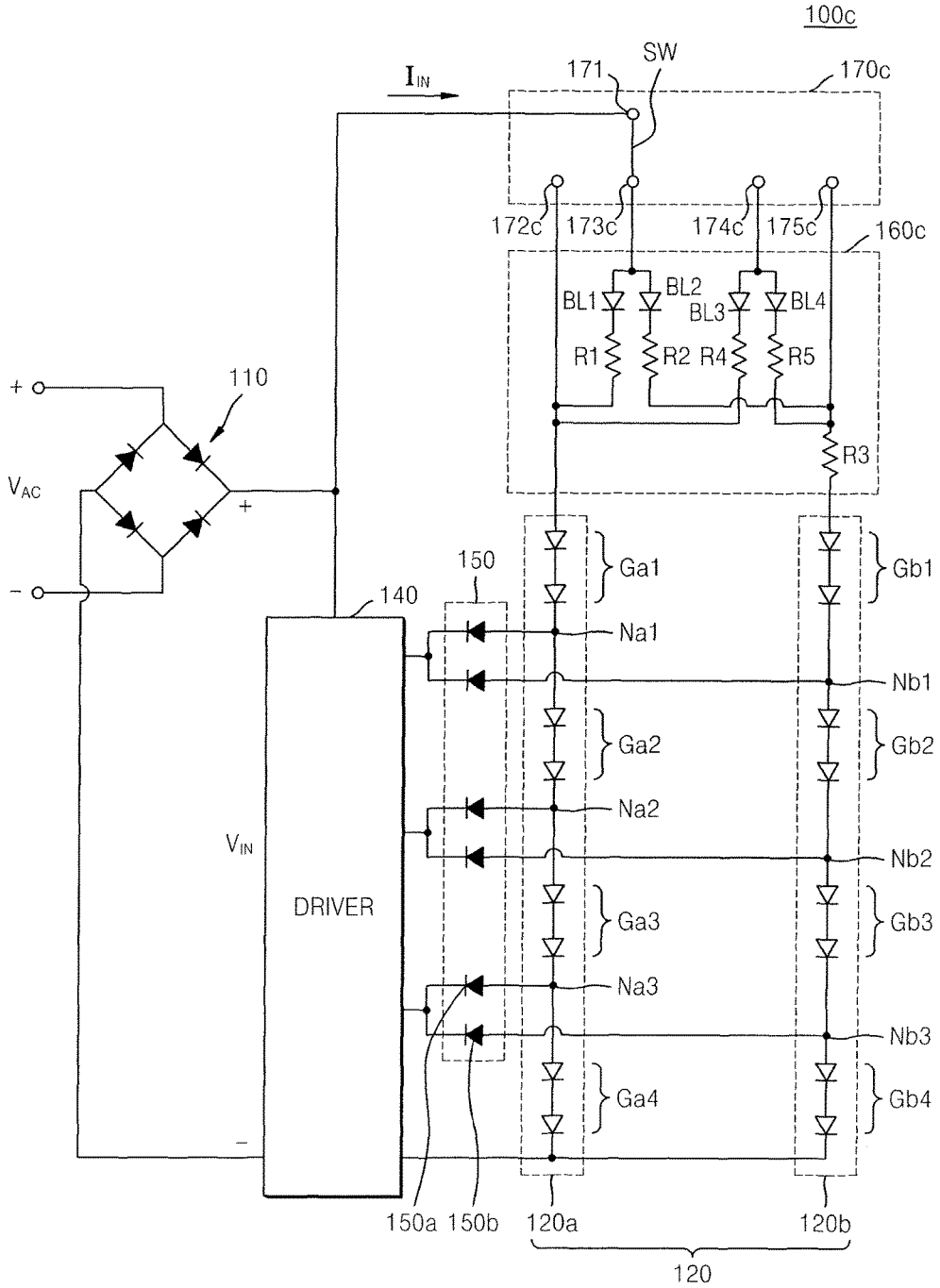
FIG. 7C illustrates a circuit diagram when the input terminal is connected to a second selection terminal by the switch in the lighting module of FIG. 7A.

FIG. 7C illustrates a circuit diagram when the input terminal 171 is connected to the second selection terminal 173*c* by the switch SW in the lighting module 100*c* of FIG. 7A.

Referring to FIG. 7C, the driving current $I_{IN}$ supplied to the input terminal 171 may be supplied to the second selection terminal 173*c* via the switch SW. A portion of the driving current $I_{IN}$ supplied to the second selection terminal 173*b* may flow through the first balance LED BL1 and the first balance resistor R1 to the first LED string 120*a*. The remaining portion of the driving current $I_{IN}$ supplied to the second selecting terminal 173*c* may flow through the second balance LED BL2, the second balance resistor R2, and the third balance resistor R3 to the second LED string 120*b*. Accordingly, the light emitter 120 may emit the light of a first mixed color temperature in which the light of the first color temperature emitted from the first LED string 120*a* and the light of the second color temperature emitted from the second LED string 120*b* are mixed.

Figure 7D:
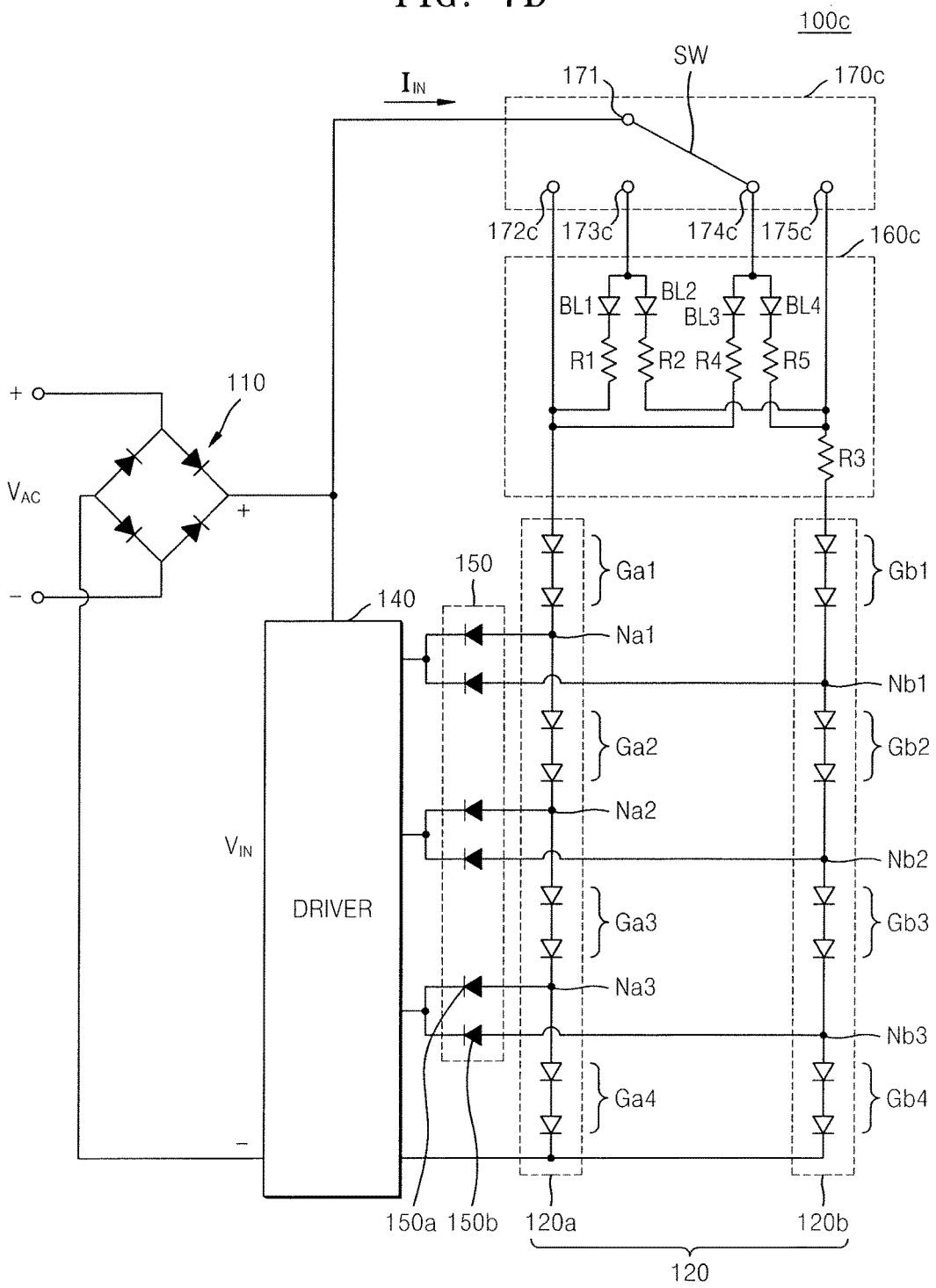
FIG. 7D illustrates a circuit diagram when the input terminal is connected to a third selection terminal by the switch in the lighting module of FIG. 7A.

FIG. 7D illustrates a circuit diagram when the input terminal 171 is connected to the third selection terminal 174*c* by the switch SW in the lighting module 100*c* of FIG. 7A.

Referring to FIG. 7D, the driving current $I_{IN}$ supplied to the input terminal 171 may be supplied to the third selection terminal 174*c* via the switch SW. A portion of the driving current $I_{IN}$ supplied to the third selection terminal 174*c* may flow through the third balance LED BL3 and the fourth balance resistor R4 to the first LED string 120*a*. The remaining portion of the driving current TIN supplied to the third selection terminal 174*c* may flow through the fourth balance LED BL4, the fifth balance resistor R5, and the third balance resistor R3 to the second LED string 120*b*. Accordingly, the light emitter 120 may emit light of a second mixed color temperature in which the light of the first color temperature emitted from the first LED string 120*a* and the light of the second color temperature emitted from the second LED string 120*b* are mixed. When the first and second balance resistors are different from the fourth and fifth balance resistors, the second mixed color temperature may be different from the first mixed color temperature.

Figure 7E:
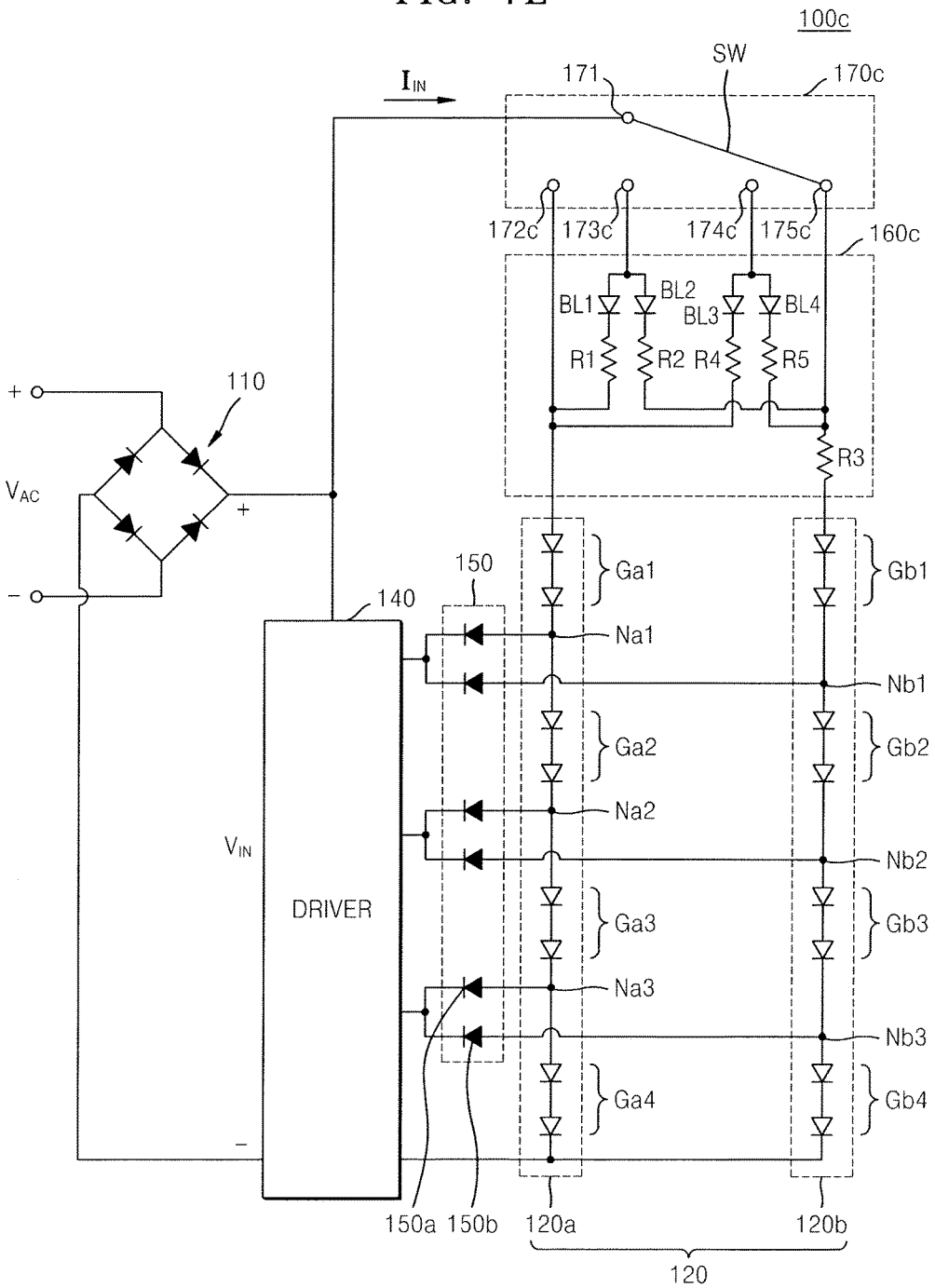
FIG. 7E illustrates a circuit diagram when the input terminal is connected to a fourth selection terminal by the switch in the lighting module of FIG. 7A.

FIG. 7E illustrates a circuit diagram when the input terminal 171 is connected to the fourth selection terminal 175*c* by the switch SW in the lighting module 100*c* of FIG. 7A.

Referring to FIG. 7E, the driving current $I_{IN}$ supplied to the input terminal 171 may be supplied to the fourth selection terminal 175*c* via the switch SW. The driving current $I_{IN}$ supplied to the fourth selection terminal 175*c* may flow through the third balance resistor R3 to the second LED string 120*b*. Accordingly, the light emitter 120 may emit the light of the second color temperature.

As such, the lighting module 100*c* according to an example embodiment may implement a plurality of mixed color temperatures by using the first LED string 120*a* configured to emit the light of the first color temperature and the second LED string 120*b* configured to emit the light of the second color temperature.

Figure 8A:
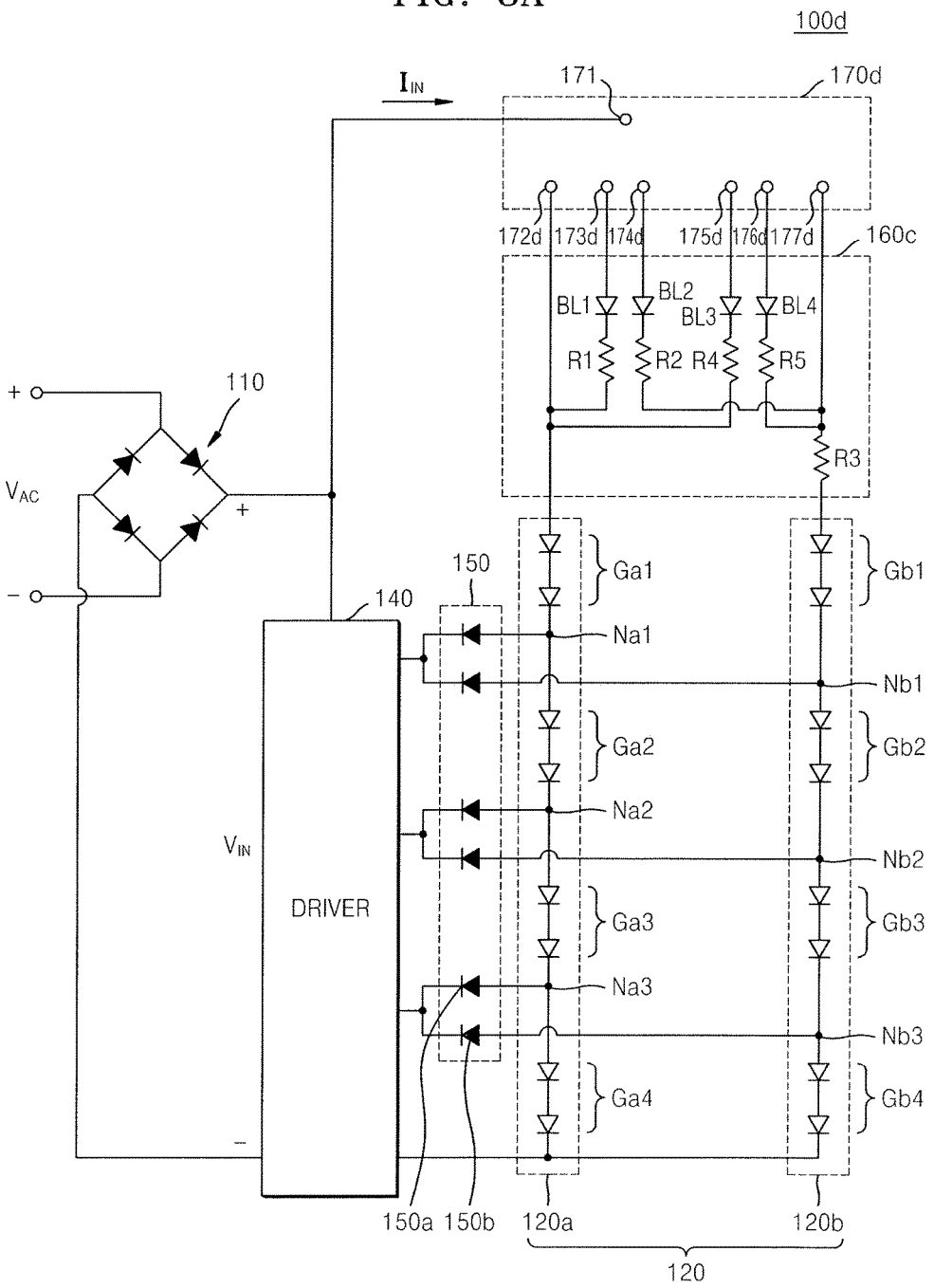
FIG. 8A illustrates a circuit diagram of a lighting module according to an example embodiment.

FIG. 8A illustrates a circuit diagram of a lighting module 100*d* according to an example embodiment. Hereinafter, differences between the embodiment illustrated in FIG. 8A and the embodiment illustrated in FIG. 6A are described.

Referring to FIG. 8A, a terminal unit 170*d* may include the input terminal 171 and six selection terminals (first through sixth selection terminals 172*d* through 177*d*). Each of the first selection terminal 172*d*, the second selection terminal 173*d*, and the fourth selection terminal 175*d*, when connected to the input terminal 171 by a switch, may be configured to supply the driving current $I_{IN}$ to the first LED string 120*a*. Each of the third selection terminal 174*d*, the fifth selection terminal 176*d*, and the sixth selection terminal 177*d*, when connected to the input terminal 171 by the switch, may be configured to supply the driving current $I_{IN}$ to the second LED string 120*b*.

The third balance LED BL3 and the fourth balance resistor R4 may be between the fourth selection terminal 175*d* and the first LED string 120*a*. The fourth balance LED BL4 and the fifth balance resistor R5 may be between the fifth selection terminal 176*d* and the second LED string 120*b*. When the balancing unit 160*c* includes the third balance resistor R3, the fourth balance LED BL4 and the fourth balance resistor R4 may be between the fifth selection terminal 176*d* and the third balance resistor R3.

Figure 8B:
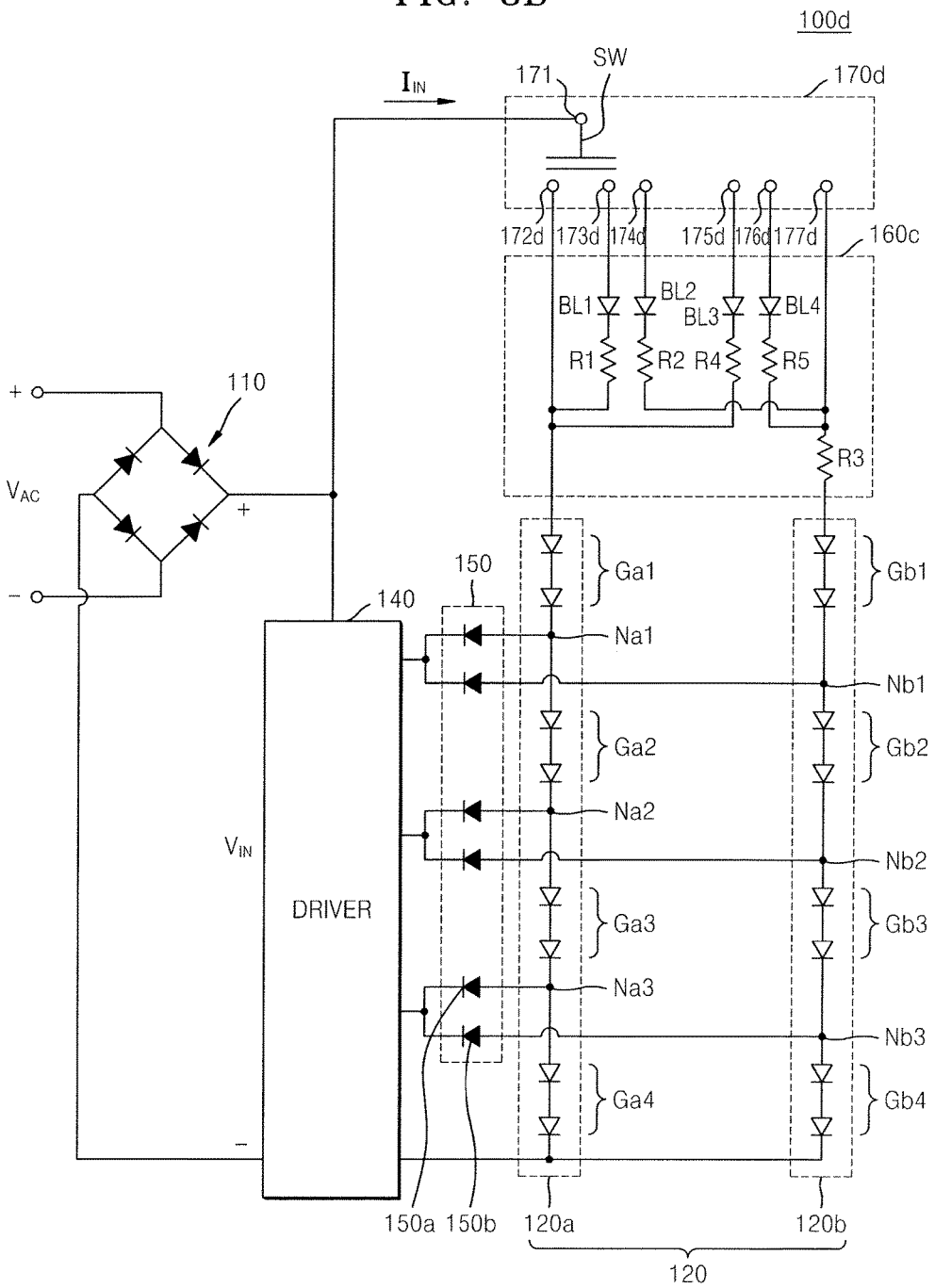
FIG. 8B illustrates a circuit diagram when an input terminal is connected to a first selection terminal and a second selection terminal by a switch in the lighting module of FIG. 8A.

FIG. 8B illustrates a circuit diagram when the input terminal 171 is connected to the first selection terminal 172*d* and the second selection terminal 173*d* by a switch SW in the lighting module 100*d* of FIG. 8A.

Referring to FIG. 8B, the driving current $I_{IN}$ supplied to the input terminal 171 may be supplied to the first selection terminal 172*d* via the switch SW. The driving current $I_{IN}$ supplied to the first selection terminal 172*d* may flow to the first LED string 120*a*. Accordingly, the light emitter 120 may emit the light of the first color temperature.

Figure 8C:
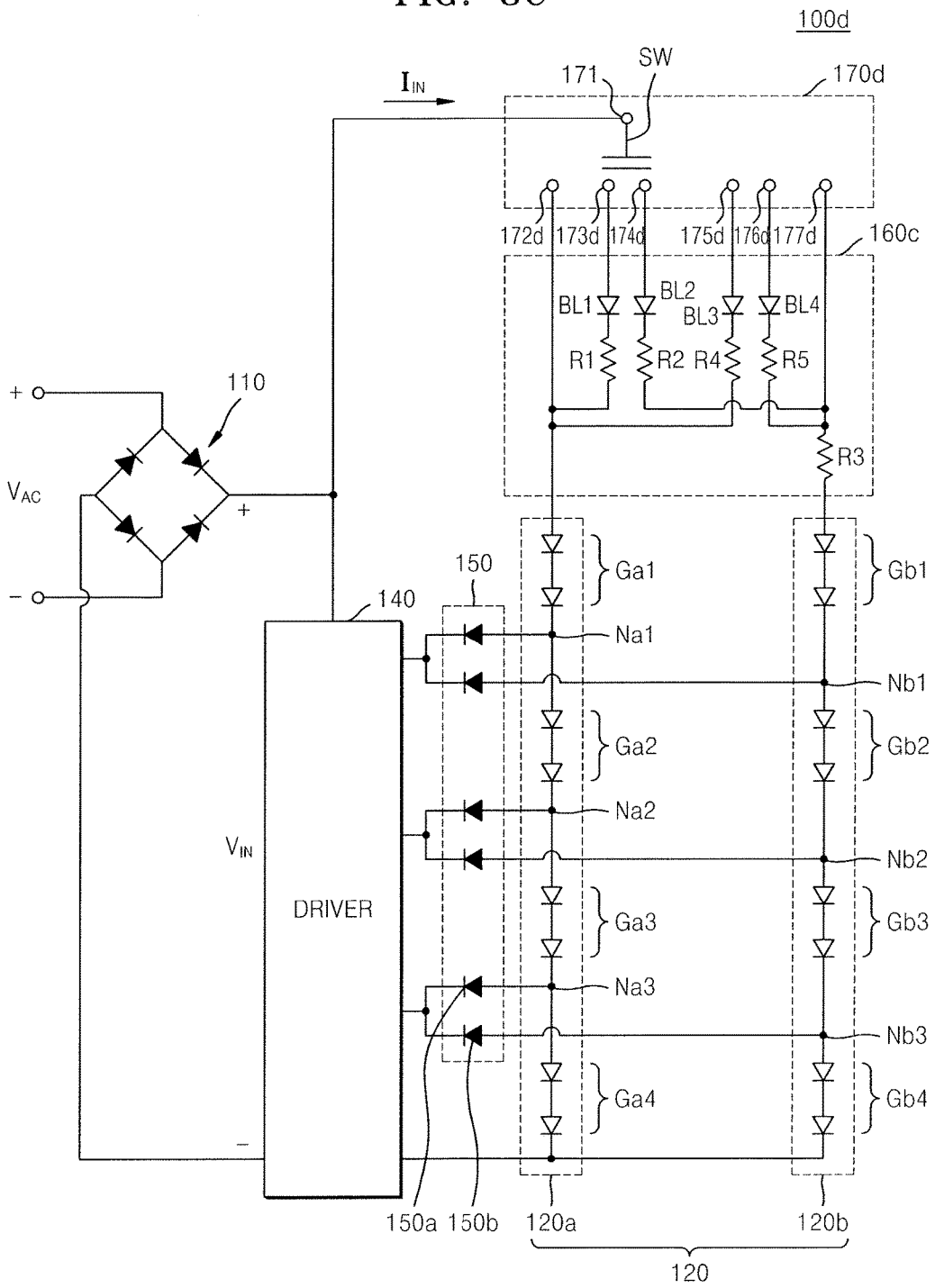
FIG. 8C illustrates a circuit diagram when the input terminal is connected to the second selection terminal and a third selection terminal by the switch in the lighting module of FIG. 8A.

FIG. 8C illustrates a circuit diagram when the input terminal 171 is connected to the second selection terminal 173*d* and the third selection terminal 174*d* by the switch SW in the lighting module 100*d* of FIG. 8A.

Referring to FIG. 8C, a portion of the driving current $I_{IN}$ supplied to the input terminal 171 may be supplied to the second selection terminal 173*d* via the switch SW and the remaining portion thereof may be supplied to the third selection terminal 174*d*. Current supplied to the second selection terminal 173*d* may flow through the first balance LED BL1 and the first balance resistor R1 to the first LED string 120*a*. Current supplied to the third selection terminal 174*d* may flow through the second balance LED BL2, the second balance resistor R2, and the third balance resistor R3 to the second LED string 120*b*. Accordingly, the light emitter 120 may emit light of a first mixed color temperature in which the light of the first color temperature and the light of the second color temperature are mixed.

Figure 8D:
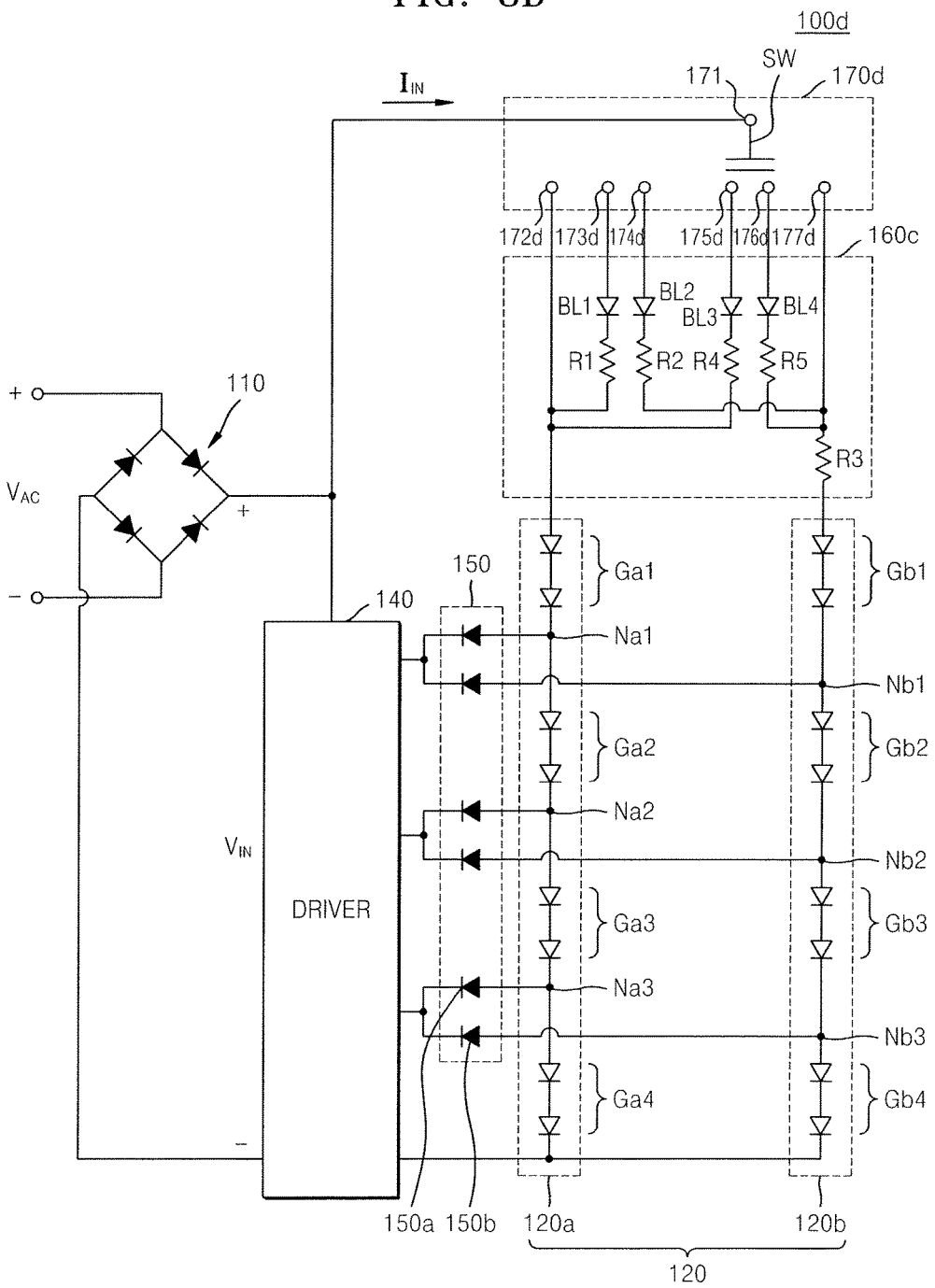
FIG. 8D illustrates a circuit diagram when the input terminal is connected to a fourth selection terminal and a fifth selection terminal by the switch in the lighting module of FIG. 8A.

FIG. 8D illustrates a circuit diagram when the input terminal 171 is connected to the fourth selection terminal 175*d* and the fifth selection terminal 176*d* by the switch SW in the lighting module 100*d* of FIG. 8A.

Referring to FIG. 8D, a portion of the driving current $I_{IN}$ supplied to the input terminal 171 may be supplied to the fourth selection terminal 175*d* via the switch SW and the remaining portion thereof may be supplied to the fifth selection terminal 176*d*. Current supplied to the fourth selection terminal 175*d* may flow through the third balance LED BL3 and the fourth balance resistor R4 to the first LED string 120*a*. Current supplied to the fifth selection terminal 176*d* may flow through the fourth balance LED BL4, the fifth balance resistor R5, and the third balance resistor R3 to the second LED string 120*b*. Accordingly, the light emitter 120 may emit the light of the second mixed color temperature in which the light of the first color temperature and the light of the second color temperature are mixed.

Figure 8E:
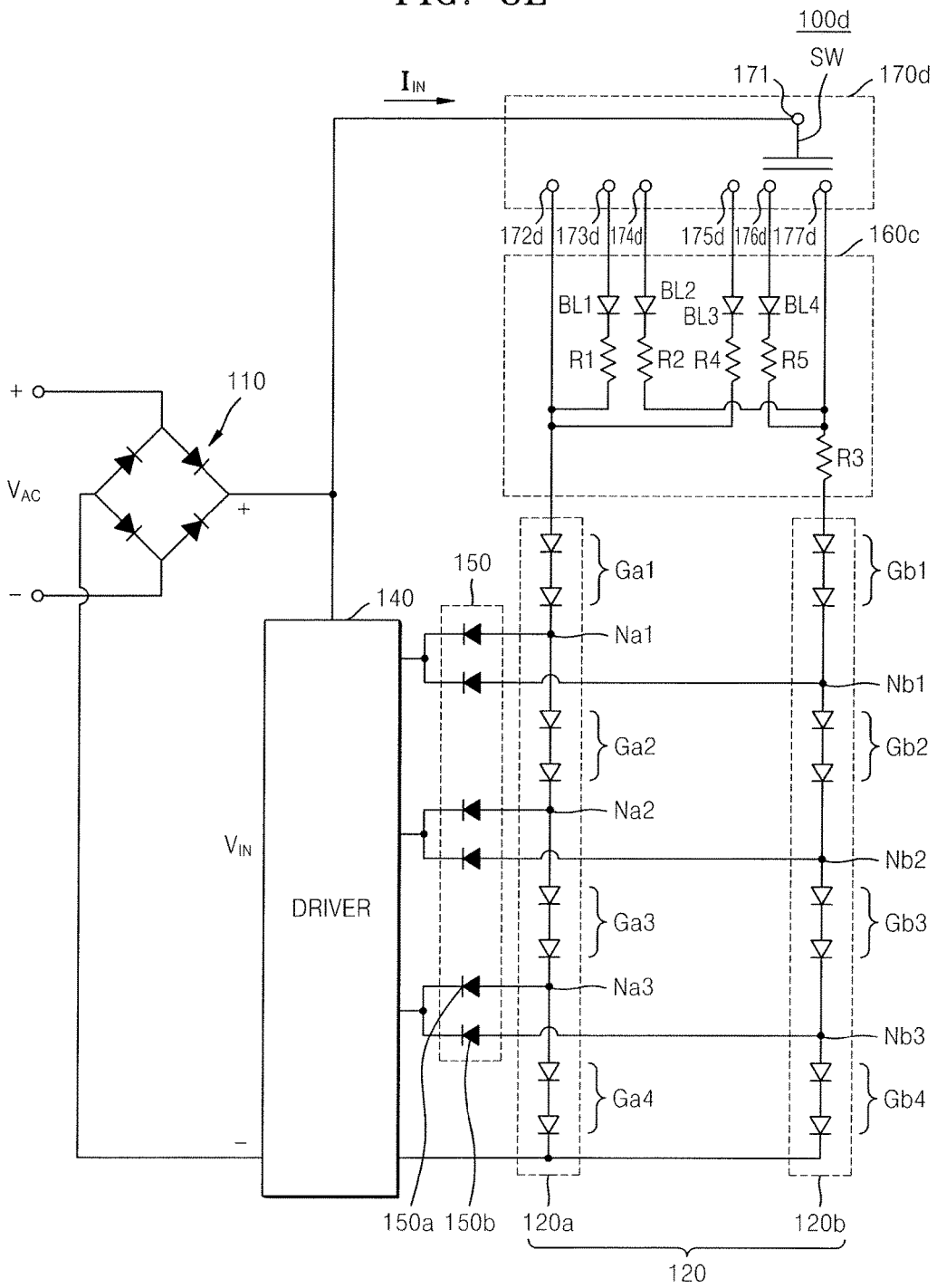
FIG. 8E illustrates a circuit diagram when the input terminal is connected to the fifth selection terminal and a sixth selection terminal by the switch in the lighting module of FIG. 8A.

FIG. 8E illustrates a circuit diagram when the input terminal 171 is connected to the fifth selection terminal 176*d* and the sixth selection terminal 177*d* by the switch SW in the lighting module 100*d* of FIG. 8A.

Referring to FIG. 8E, the driving current $I_{IN}$ supplied to the input terminal 171 may be supplied to the sixth selection terminal 177*d* via the switch SW. The driving current $I_{IN}$ supplied to the sixth selection terminal 177*d* may flow through the third balance resistor R3 to the second LED string 120*b*. Accordingly, the light emitter 120 may emit the light of the second color temperature.

Figure 9:
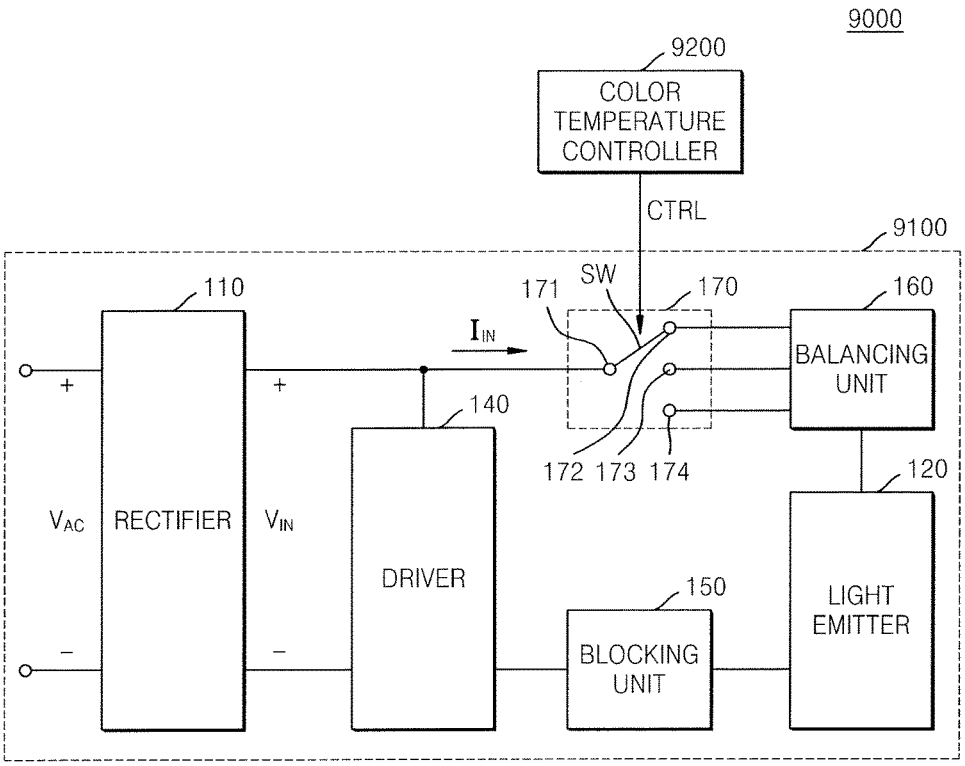
FIG. 9 illustrates a block diagram of a lighting apparatus according to an example embodiment.

FIG. 9 illustrates a block diagram of a lighting apparatus 9000 according to an example embodiment.

Referring to FIG. 9, the lighting apparatus 9000 may include a lighting module 9100 and a switch SW. The lighting module 9100 may be one of the lighting modules 100, 100*a*, 100*b*, 100*c*, and 100*d* illustrated in FIGS. 2, 5, 6*a*, 7*a*, and 8*a*. The switch SW may be a suitable component configured to connect the input terminal 171 of the lighting module 9100 to at least one of the first through fourth selection terminals 172 through 174. The switch SW may be, for example, a toggle switch, a slide switch, a rotary switch, an electronic or digital switch, etc. The switch SW may be fixed by the lighting manufacturer or may be dynamically operated by a lighting user. In an example embodiment, the switch SW may be included in the lighting module 9100.

In an example embodiment, the lighting apparatus 9000 may further include a color temperature controller 9200. The color temperature controller 9200 may transmit a control signal CTRL for controlling the switch SW to the switch SW in a wired or wireless manner. For example, the lighting user or the lighting manufacturer may control the switch SW via the color temperature controller 9200 to cause the lighting apparatus 9000 to emit light of a certain color temperature.

By way of summation and review, a color temperature changeable lighting module and a lighting apparatus capable of emitting light of two or more color temperatures by using LEDs of different color temperatures may be considered. The color temperature changeable lighting apparatus may facilitate a user to utilize light of various color temperatures by using only one lighting apparatus, and may simplify production and inventory management of a lighting manufacturer.

As described above, embodiments relate to a color temperature changeable LED lighting module and a lighting apparatus including the same.

Embodiments may provide a changeable color temperature light-emitting diode (LED) lighting module that may reduce a luminance difference by a color temperature and may be inexpensive, and a lighting apparatus including the same.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A lighting module, comprising:

a light emitter including a first light-emitting diode (LED) string configured to emit light of a first color temperature and a second LED string configured to emit light of a second color temperature;

a terminal unit configured to provide terminals capable of supplying a driving current to at least one of the first LED string and the second LED string; and a balancing unit including a first balance LED, a second balance LED, a first balance resistor, and a second balance resistor, the balancing unit configured to adjust a mixed color temperature that is a color temperature of light emitted from the light emitter when the driving current is supplied to the first LED string and the second LED string, and reduce a luminance difference between the light of the mixed color temperature and one of the light of the first color temperature emitted from the light emitter when the driving current is supplied to the first LED string and the driving current is not supplied to the second LED string and the light of the second color temperature emitted from the light emitter when the driving current is supplied to the second LED string and the driving current is not supplied to the first LED string.

2. The lighting module as claimed in claim 1, wherein the first balance LED is connected in series to the first balance resistor, and the second balance LED is connected in series to the second balance resistor.

3. The lighting module as claimed in claim 2, wherein the balancing unit further includes a third balance resistor configured to reduce a luminance difference between the light of the first color temperature and the light of the second color temperature.

4. The lighting module as claimed in claim 1, wherein the first balance LED is configured to emit the light of the first color temperature and the second balance LED is configured to emit the light of the second color temperature.

5. The lighting module as claimed in claim 1, wherein the terminal unit includes an input terminal configured to be supplied with the driving current and at least three selection terminals each configured to be connected to the input terminal via a switch.

6. The lighting module as claimed in claim 1, further comprising a rectifier configured to provide a driving current that changes as a function of time from an alternating current.

7. The lighting module as claimed in claim 1, further comprising a driver configured to control the driving current according to a driving voltage and control a number of LEDs through which at least a portion of the driving current flows among LEDs in the light emitter.

8. The lighting module as claimed in claim 7, further comprising a blocking unit configured to block current flowing from the driver to the first LED string or the second LED string.

9. A lighting module, comprising:

a lighting unit including a first light-emitting diode (LED) string configured to emit light of a first color temperature and a second LED string configured to emit light of a second color temperature;

an input terminal configured to provide a driving current;

at least three selection terminals that, when connected to the input terminal, supply the driving current to at least one of the first LED string and the second LED string; and a balancing unit between the at least three selection terminals and the lighting unit, wherein the balancing unit includes a first balance LED configured to emit light of the first color temperature, a first balance resistor connected in series to the first balance LED, a second balance LED configured to emit light of the second color temperature, and a second balance resistor connected in series to the second balance LED, and wherein the lighting unit emits light of a mixed color temperature when the driving current is supplied to the first LED string and the second LED string.

10. The lighting module as claimed in claim 9, wherein the at least three selection terminals include a first selection terminal configured to supply the driving current to the first LED string when connected to the input terminal, a second selection terminal configured to supply the driving current to the first LED string and the second LED string when connected to the input terminal, and a third selection terminal configured to supply the driving current to the second LED string when connected to the input terminal.

11. The lighting module as claimed in claim 10, wherein the second color temperature is higher than the first color temperature, and the balancing unit further includes a third balance resistor between the second LED string and the third selection terminal.

12. The lighting module as claimed in claim 11, wherein the first balance LED and the first balance resistor are between the first LED string and the second selection terminal, and the second balance LED and the second balance resistor are between the third balance resistor and the second selection terminal.

13. A lighting apparatus comprising the lighting module as claimed in claim 9.

14. The lighting apparatus as claimed in claim 13, further comprising a switch configured to connect the input terminal to one of the at least three selection terminals.

15. The lighting apparatus as claimed in claim 14, further comprising a color temperature controller configured to control the switch.

16. A lighting apparatus, comprising:

a first light-emitting diode (LED) string configured to emit light of a first color temperature;

a second LED string configured to emit light of a second color temperature;

an input terminal configured to supply a driving current;

a first selection terminal configured to supply the driving current to the first LED string;

a second selection terminal configured to divide the driving current and supply the divided driving current to the first LED string and the second LED string;

a third selection terminal configured to supply the driving current to the second LED string;

a switch configured to connect the input terminal to one of the first selection terminal, the second selection terminal, and the third selection terminal; and a balancing unit including a first balance resistor between the second selection terminal and the first LED string, and a second balance resistor between the second selection terminal and the second LED string.

17. The lighting apparatus as claimed in claim 16, wherein the second color temperature is higher than the first color temperature, the balancing unit further includes a third balance resistor between the third selection terminal and the second LED string, and the second balance resistor is between the second selection terminal and the third balance resistor.

18. The lighting apparatus as claimed in claim 16, further comprising a first balance LED connected in series to the first balance resistor and a second balance LED connected in series to the second balance resistor.

19. The lighting apparatus as claimed in claim 16, further comprising a driver configured to receive the driving current from the first LED string and the second LED string.

20. The lighting apparatus as claimed in claim 19, further comprising block diodes between the driver and the first LED string and between the driver and the second LED string.

* * * * *